US009593491B2

(12) United States Patent
Engstrom

(10) Patent No.: US 9,593,491 B2
(45) Date of Patent: Mar. 14, 2017

(54) SET OF PANELS

(71) Applicant: PERGO (EUROPE) AB, Trelleborg (SE)

(72) Inventor: Nils-Erik Engstrom, Trelleborg (SE)

(73) Assignee: PERGO (EUROPE) AB, Trelleborg (SE)

( * ) Notice: Subject to any disclaimer, the term of this patent is extended or adjusted under 35 U.S.C. 154(b) by 0 days.

(21) Appl. No.: 14/658,954

(22) Filed: Mar. 16, 2015

(65) Prior Publication Data

US 2015/0184397 A1 Jul. 2, 2015

Related U.S. Application Data

(63) Continuation of application No. 14/223,365, filed on Mar. 24, 2014, now Pat. No. 8,978,334, which is a (Continued)

(30) Foreign Application Priority Data

May 10, 2010 (DE) ..... 10 2010 020 089

(51) Int. Cl.
*E04F 15/02* (2006.01)
*E04F 15/04* (2006.01)

(52) U.S. Cl.
CPC ..... *E04F 15/02005* (2013.01); *E04F 15/02* (2013.01); *E04F 15/02038* (2013.01);

(Continued)

(58) Field of Classification Search
CPC ..... E04F 15/02; E04F 15/02005; E04F 15/02038

(Continued)

(56) References Cited

U.S. PATENT DOCUMENTS 87,853 A 3/1869 Kappes
108,068 A 10/1870 Utley (Continued)

FOREIGN PATENT DOCUMENTS

AT 000 112 U2 2/1995
AT 002214 U1 6/1998

(Continued)

OTHER PUBLICATIONS

Knight's American Mechanical Dictionary, vol. III. 1876, definiton of scarf.

(Continued)

*Primary Examiner* — William Gilbert
(74) *Attorney, Agent, or Firm* — Jenkins, Wilson, Taylor & Hunt, P.A.

(57) ABSTRACT

The invention relates to a set of panels, in particular floor panels, comprising a first panel and at least a second panel. The panels are respectively provided with a first edge and with a second edge, wherein the first edge and the second edge are configured to establish a connection between the first and the second panel. The first edge can have a lower lip with a step, and the second edge can have a downwardly open locking groove. A separate clip can be provided which can be attached to the first edge or the second edge and has a moveable clip head, which in the connected state of the panels can cooperate with a locking surface on the second edge or the first edge, respectively, in order to lock the panels vertically relative to the plane of laying.

26 Claims, 2 Drawing Sheets

Related U.S. Application Data continuation of application No. 13/086,931, filed on Apr. 14, 2011, now Pat. No. 8,720,148.

(52) U.S. Cl.
CPC ..... *E04F 15/04* (2013.01); *E04F 2201/0138* (2013.01); *E04F 2201/0146* (2013.01); *E04F 2201/0153* (2013.01); *E04F 2201/023* (2013.01); *E04F 2201/049* (2013.01); *E04F 2201/0523* (2013.01)

(58) Field of Classification Search
USPC .. 52/391, 582.1, 582.2, 584.1, 587.1, 586.1, 52/586.2, 585.1; 428/50
See application file for complete search history.

(56) References Cited

U.S. PATENT DOCUMENTS 208,036 A 9/1878 Robley
213,740 A 4/1879 Conner
274,354 A 3/1883 McCarthy et al.
308,313 A 11/1884 Gerike
338,653 A 5/1886 Whitmore
342,529 A 5/1886 McRae
502,289 A 8/1893 Feldman
662,458 A 11/1900 Nagel
713,577 A 11/1902 Wickham
714,987 A 12/1902 Wolfe
752,694 A 2/1904 Lund
753,791 A 3/1904 Fulghum
769,355 A 9/1904 Platow
832,003 A 9/1906 Torrence
847,272 A 3/1907 Ayers
877,639 A 1/1908 Galbraith
890,436 A 6/1908 Momberg
898,381 A 9/1908 Mattison
1,000,859 A 8/1911 Vaughan
1,002,102 A 8/1911 Weedon
1,016,383 A 2/1912 Wellman
1,078,776 A 11/1913 Dunton
1,097,986 A 5/1914 Moritz
1,124,226 A 1/1915 Houston
1,124,228 A 1/1915 Houston
1,137,197 A 4/1915 Ellis
1,140,958 A 5/1915 Cowan
1,201,285 A 10/1916 Gray
1,266,253 A 5/1918 Hakason
1,319,286 A 10/1919 Johnson et al.
1,357,713 A 11/1920 Lane
1,371,856 A 3/1921 Cade
1,407,679 A 2/1922 Ruchrauff
1,411,415 A 4/1922 Cooley
1,436,858 A 11/1922 Reinhart
1,454,250 A 5/1923 Parsons
1,468,288 A 9/1923 Fen
1,510,924 A 10/1924 Daniels et al.
1,540,128 A 6/1925 Houston
1,575,821 A 3/1926 Daniels
1,576,527 A 3/1926 McBride
1,576,821 A 3/1926 Daniels
1,602,256 A 10/1926 Sellin
1,602,267 A 10/1926 Karwisde
1,615,096 A 1/1927 Myers
1,622,103 A 3/1927 Fulton
1,622,104 A 3/1927 Fulton
1,637,634 A 8/1927 Carter
1,644,710 A 10/1927 Crooks
1,657,159 A 1/1928 Greenebaum
1,660,480 A 2/1928 Daniels
1,706,924 A 3/1929 Kane
1,714,738 A 5/1929 Smith
1,718,702 A 6/1929 Pfiester
1,723,306 A 8/1929 Sipe
1,734,826 A 11/1929 Pick
1,736,539 A 11/1929 Lachman
1,743,492 A 1/1930 Sipe
1,764,331 A 6/1930 Moratz
1,772,417 A 8/1930 Ellinwood
1,776,188 A 9/1930 Langbaum
1,823,039 A 9/1930 Gruner
1,778,069 A 10/1930 Fetz
1,787,027 A 12/1930 Wasleff
1,801,093 A 4/1931 Larkins
1,843,024 A 1/1932 Werner
1,854,396 A 4/1932 Davis
1,859,667 A 5/1932 Gruner
1,864,774 A 6/1932 Storm
1,477,813 A 12/1932 Daniels et al.
1,898,364 A 2/1933 Gynn
1,906,411 A 5/1933 Potvin
1,913,342 A 6/1933 Schaffert
1,929,871 A 10/1933 Jones
1,940,377 A 12/1933 Storm
1,946,646 A 2/1934 Storm
1,953,306 A 4/1934 Moratz
1,966,020 A 7/1934 Rowley
1,978,075 A 10/1934 Butterworth
1,986,739 A 1/1935 Mitte
1,988,201 A 1/1935 Hall
1,991,701 A 2/1935 Roman
2,004,193 A 6/1935 Cherry
2,015,813 A 10/1935 Nielsen
2,027,292 A 1/1936 Rockwell
2,044,216 A 6/1936 Klages
2,045,067 A 6/1936 Bruce
2,049,571 A 8/1936 Schuck
2,088,405 A 7/1937 Cahn
2,100,238 A 11/1937 Burgess
RE20,816 E 8/1938 Haase
2,126,956 A 8/1938 Gilbert
2,138,085 A 11/1938 Birtles
2,141,708 A 12/1938 Elmendorf
2,142,305 A 1/1939 Davis
2,194,086 A 3/1940 Horn
2,199,938 A 5/1940 Kloote
2,222,137 A 11/1940 Bruce
2,226,540 A 12/1940 Boettcher
2,238,169 A 4/1941 Heyn et al.
2,245,497 A 6/1941 Potchen
2,253,943 A 8/1941 Rice
2,261,897 A 11/1941 Adams
2,263,930 A 11/1941 Pasquier
2,266,464 A 12/1941 Kraft
2,276,071 A 3/1942 Scull
2,280,071 A 4/1942 Hamilton
2,282,559 A 5/1942 Byers
2,324,628 A 7/1943 Kahr
2,360,933 A 10/1944 Bunker
2,363,429 A 11/1944 Lowry
2,381,469 A 8/1945 Sweet
2,398,632 A 4/1946 Frost et al.
2,405,602 A 8/1946 Nugent
2,430,200 A 11/1947 Wilson
2,441,364 A 5/1948 Maynard
2,487,571 A 11/1949 Maxwell
2,491,498 A 12/1949 Kahr
2,534,501 A 12/1950 Coleman
2,644,552 A 7/1953 MacDonanld
2,717,420 A 9/1955 Georges
2,729,584 A 1/1956 Foster
2,740,167 A 4/1956 Rowley
2,780,253 A 2/1957 Joa
2,805,852 A 9/1957 Ewert
2,808,624 A 10/1957 Sullivan
2,823,433 A 2/1958 Kendall
2,839,790 A 6/1958 Collings
2,857,302 A 10/1958 Burton et al.
2,863,185 A 12/1958 Reidi
2,865,058 A 12/1958 Ake Andersson et al.
2,875,117 A 2/1959 Potchen et al.
2,878,530 A 3/1959 Hilding
2,894,292 A 7/1959 Gramelspacher
2,914,815 A 12/1959 Alexander

(56) References Cited

U.S. PATENT DOCUMENTS

| | | | |
|---|---|---|---|
| 2,926,401 | A | 3/1960 | Place |
| 2,947,040 | A | 8/1960 | Schultz |
| 2,831,223 | A | 9/1960 | DeShazor |
| 2,952,341 | A | 9/1960 | Weiler |
| 2,974,692 | A | 3/1961 | Bolenbach |
| 2,996,751 | A | 8/1961 | Roby |
| 3,039,575 | A | 6/1962 | Graham |
| 3,040,388 | A | 6/1962 | Conn |
| 3,045,294 | A | 7/1962 | Livezey, Jr. |
| 3,090,082 | A | 5/1963 | Bauman |
| 3,100,556 | A | 8/1963 | Ridder |
| 3,125,138 | A | 3/1964 | Bolenbach |
| 3,128,851 | A | 4/1964 | Deridder et al. |
| 3,141,392 | A | 7/1964 | Schneider |
| 3,145,503 | A | 8/1964 | Brechin |
| 3,148,482 | A | 9/1964 | Neale |
| 3,162,906 | A | 12/1964 | Dudley |
| 3,172,508 | A | 3/1965 | Doering et al. |
| 3,174,411 | A | 3/1965 | Oestrich et al. |
| 3,175,476 | A | 3/1965 | Franks |
| 3,182,769 | A | 5/1965 | De Ridder |
| 3,192,574 | A | 7/1965 | Jaffe et al. |
| 3,199,258 | A | 8/1965 | Jentoft et al. |
| 3,200,553 | A | 8/1965 | Frashour et al. |
| 3,203,149 | A | 8/1965 | Soddy |
| 3,204,380 | A | 9/1965 | Wilson |
| 3,205,633 | A | 9/1965 | Nusbaum |
| 3,253,377 | A | 5/1966 | Schakel |
| 3,257,225 | A | 6/1966 | Marotta |
| 3,267,630 | A | 8/1966 | Omholt |
| 3,282,010 | A | 11/1966 | King, Jr. |
| 3,286,425 | A | 11/1966 | Brown |
| 3,296,056 | A | 1/1967 | Bechtold |
| 3,301,147 | A | 1/1967 | Clayton |
| 3,310,919 | A | 3/1967 | Bue |
| 3,313,072 | A | 4/1967 | Cue |
| 3,331,171 | A | 7/1967 | Hallock |
| 3,331,176 | A | 7/1967 | Washam |
| 3,332,192 | A | 7/1967 | Kessler et al. |
| 3,339,329 | A | 9/1967 | Berg |
| 3,347,048 | A | 10/1967 | Brown et al. |
| 3,362,127 | A | 1/1968 | McGowan |
| 3,363,381 | A | 1/1968 | Forrest |
| 3,363,382 | A | 1/1968 | Forrest |
| 3,363,383 | A | 1/1968 | La Barge |
| 3,373,071 | A | 3/1968 | Fuerst |
| 3,377,931 | A | 4/1968 | Hilton |
| 3,385,182 | A | 5/1968 | Harvey |
| 3,387,422 | A | 6/1968 | Wanzer |
| 3,397,496 | A | 8/1968 | Sohns |
| 3,444,660 | A | 5/1969 | Feichter |
| 3,449,879 | A | 6/1969 | Bloom |
| 3,460,304 | A | 8/1969 | Braeuninger et al. |
| 3,473,278 | A | 10/1969 | Gossen |
| 3,474,584 | A | 10/1969 | Lynch |
| 3,479,784 | A | 11/1969 | Massagli |
| 3,481,810 | A | 12/1969 | Waite |
| 3,488,828 | A | 1/1970 | Gallagher |
| 3,496,119 | A | 2/1970 | Fitzgerald |
| 3,508,369 | A | 4/1970 | Tennison |
| 3,512,324 | A | 5/1970 | Reed |
| 3,526,420 | A | 9/1970 | Brancaleone |
| 3,535,844 | A | 10/1970 | Glaros |
| 3,538,665 | A | 11/1970 | Gohner |
| 3,538,819 | A | 11/1970 | Gould et al. |
| 3,548,559 | A | 12/1970 | Levine |
| 3,553,919 | A | 1/1971 | Omholt |
| 3,555,761 | A | 1/1971 | Rosebrough |
| 3,555,762 | A | 1/1971 | Costanzo, Jr. |
| 3,570,205 | A | 3/1971 | Payne |
| 3,572,224 | A | 3/1971 | Perry |
| 3,579,941 | A | 5/1971 | Tibbals |
| 3,605,368 | A | 9/1971 | Lalouche |
| 3,619,964 | A | 11/1971 | Passaro et al. |
| 3,627,362 | A | 12/1971 | Brenneman |
| 3,640,191 | A | 2/1972 | Hendrich |
| 3,657,852 | A | 4/1972 | Worthington et al. |
| 3,665,666 | A | 5/1972 | Delcroix |
| 3,667,153 | A | 6/1972 | Christensen |
| 3,671,369 | A | 6/1972 | Kvalheim et al. |
| 3,673,751 | A | 7/1972 | Boassy et al. |
| 3,676,971 | A | 7/1972 | Dombroski |
| 3,679,531 | A | 7/1972 | Wienand et al. |
| 3,687,773 | A | 8/1972 | Wangborg |
| 3,694,983 | A | 10/1972 | Couquet |
| 3,696,575 | A | 10/1972 | Armstrong |
| 3,707,061 | A | 12/1972 | Collette et al. |
| 3,714,747 | A | 2/1973 | Curran |
| 3,720,027 | A | 3/1973 | Christensen |
| 3,731,445 | A | 5/1973 | Hoffmann et al. |
| 3,740,914 | A | 6/1973 | Arnaiz Diez |
| 3,742,672 | A | 7/1973 | Schaeufele |
| 3,745,726 | A | 7/1973 | Thom |
| 3,758,650 | A | 9/1973 | Hurst |
| 3,759,007 | A | 9/1973 | Thiele |
| 3,760,544 | A | 9/1973 | Hawes et al. |
| 3,760,548 | A | 9/1973 | Sauer et al. |
| 3,761,338 | A | 9/1973 | Ungar et al. |
| 3,768,846 | A | 10/1973 | Hensley et al. |
| 3,778,958 | A | 12/1973 | Fowler |
| 3,780,469 | A | 12/1973 | Hancovsky |
| 3,786,608 | A | 1/1974 | Boettcher |
| 3,798,111 | A | 3/1974 | Lane et al. |
| 3,807,113 | A | 4/1974 | Turner |
| 3,808,030 | A | 4/1974 | Bell |
| 3,810,707 | A | 5/1974 | Tungseth et al. |
| 3,849,111 | A | 11/1974 | Kihlstedt |
| 3,849,240 | A | 11/1974 | Mikulak |
| 3,859,000 | A | 1/1975 | Webster |
| 3,883,258 | A | 5/1975 | Hewson |
| 3,884,008 | A | 5/1975 | Miller |
| 3,884,328 | A | 5/1975 | Williams |
| 3,902,291 | A | 9/1975 | Zucht |
| 3,902,293 | A | 9/1975 | Witt et al. |
| 3,908,053 | A | 9/1975 | Hettich |
| 3,908,062 | A | 9/1975 | Roberts |
| 3,921,312 | A | 11/1975 | Fuller |
| 3,924,496 | A | 12/1975 | DerMarderosian et al. |
| 3,936,551 | A | 2/1976 | Elmendorf et al. |
| 3,936,758 | A | 2/1976 | Kostelnicek et al. |
| 3,953,661 | A | 4/1976 | Gulley |
| 3,987,599 | A | 10/1976 | Hines |
| 3,988,187 | A | 10/1976 | Witt et al. |
| 4,021,087 | A | 5/1977 | Ferguson |
| 4,037,377 | A | 7/1977 | Howell et al. |
| 4,059,933 | A | 11/1977 | Funk et al. |
| 4,060,437 | A | 11/1977 | Strout |
| 4,065,902 | A | 1/1978 | Lindal |
| 4,067,155 | A | 1/1978 | Ruff et al. |
| 4,074,496 | A | 2/1978 | Fischer |
| 4,090,338 | A | 5/1978 | Bourgade |
| 4,094,090 | A | 6/1978 | Walmer |
| 4,095,913 | A | 6/1978 | Pettersson et al. |
| 4,099,358 | A | 7/1978 | Compaan |
| 4,100,710 | A | 7/1978 | Kowallik |
| 4,143,498 | A | 3/1979 | Martin et al. |
| 4,144,689 | A | 3/1979 | Bains |
| 4,150,517 | A | 4/1979 | Warner |
| 4,156,048 | A | 5/1979 | Davis |
| 4,158,335 | A | 6/1979 | Belcastro |
| 4,164,832 | A | 8/1979 | Van Zandt |
| 4,165,305 | A | 8/1979 | Sundie et al. |
| 4,167,599 | A | 9/1979 | Nissinen |
| 4,169,688 | A | 10/1979 | Toshio |
| 4,182,072 | A | 1/1980 | Much |
| 4,186,539 | A | 2/1980 | Harmon et al. |
| 4,196,554 | A | 4/1980 | Anderson et al. |
| 4,198,455 | A | 4/1980 | Spiro et al. |
| 4,226,064 | A | 10/1980 | Kraayenhof |
| 4,242,390 | A | 12/1980 | Nemeth |
| 4,247,390 | A | 1/1981 | Knoll |
| 4,292,774 | A | 10/1981 | Mairle |
| 4,299,070 | A | 11/1981 | Oltmanns et al. |
| 4,304,083 | A | 12/1981 | Anderson |

(56) References Cited

U.S. PATENT DOCUMENTS

| | | | |
|---|---|---|---|
| 4,316,351 | A | 2/1982 | Ting |
| 4,372,899 | A | 2/1983 | Wiemann et al. |
| 4,376,593 | A | 3/1983 | Schaefer |
| 4,390,580 | A | 6/1983 | Donovan et al. |
| 4,416,097 | A | 11/1983 | Weir |
| 4,426,820 | A | 1/1984 | Terbrack et al. |
| 4,435,935 | A | 3/1984 | Larrea |
| 4,449,346 | A | 5/1984 | Tremblay |
| 4,455,803 | A | 6/1984 | Kornberger |
| 4,461,131 | A | 7/1984 | Pressell |
| 4,471,012 | A | 9/1984 | Maxwell |
| 4,489,115 | A | 12/1984 | Layman et al. |
| 4,501,102 | A | 2/1985 | Knowles |
| 4,503,115 | A | 3/1985 | Hemels et al. |
| 4,504,347 | A | 3/1985 | Munk et al. |
| 4,505,887 | A | 3/1985 | Miyata et al. |
| 4,512,131 | A | 4/1985 | Laramore |
| 4,517,147 | A | 5/1985 | Taylor et al. |
| 4,520,062 | A | 5/1985 | Ungar et al. |
| 4,538,392 | A | 9/1985 | Hamar et al. |
| 4,561,233 | A | 12/1985 | Harter et al. |
| 4,571,910 | A | 2/1986 | Cosentino |
| 4,594,347 | A | 6/1986 | Ishikawa et al. |
| 4,599,124 | A | 7/1986 | Kelly et al. |
| 4,599,841 | A | 7/1986 | Haid |
| 4,599,842 | A | 7/1986 | Counihan |
| 4,612,745 | A | 9/1986 | Hovde |
| 4,621,471 | A | 11/1986 | Kuhr et al. |
| 4,640,437 | A | 2/1987 | Weingartner |
| 4,641,469 | A | 2/1987 | Wood |
| 4,643,237 | A | 2/1987 | Rosa |
| 4,646,494 | A | 3/1987 | Saarinen et al. |
| 4,653,138 | A | 3/1987 | Carder |
| 4,653,242 | A | 3/1987 | Ezard |
| 4,672,728 | A | 6/1987 | Nimberger |
| 4,683,631 | A | 8/1987 | Dobbertin |
| 4,703,597 | A | 11/1987 | Eggemar |
| 4,715,162 | A | 12/1987 | Brightwell |
| 4,724,187 | A | 2/1988 | Ungar et al. |
| 4,733,510 | A | 3/1988 | Werner |
| 4,736,563 | A | 4/1988 | Bilhorn |
| 4,738,071 | A | 4/1988 | Ezard |
| 4,741,136 | A | 5/1988 | Thompson |
| 4,747,197 | A | 5/1988 | Charron |
| 4,757,657 | A | 7/1988 | Mitchell |
| 4,757,658 | A | 7/1988 | Kaempen |
| 4,766,443 | A | 8/1988 | Winegard et al. |
| 4,769,963 | A | 9/1988 | Meyerson |
| 4,796,402 | A | 1/1989 | Pajala |
| 4,806,435 | A | 2/1989 | Athey |
| 4,819,532 | A | 4/1989 | Benuzzi et al. |
| 4,819,932 | A | 4/1989 | Trotter, Jr. |
| 4,831,806 | A | 5/1989 | Niese et al. |
| 4,844,972 | A | 7/1989 | Tedeschi et al. |
| 4,845,907 | A | 7/1989 | Meek |
| 4,888,933 | A | 12/1989 | Guomundsson et al. |
| 4,893,449 | A | 1/1990 | Kemper |
| 4,894,272 | A | 1/1990 | Aisley |
| 4,905,442 | A | 3/1990 | Daniels |
| 4,906,484 | A | 3/1990 | Lambuth et al. |
| 4,910,280 | A | 3/1990 | Robbins, III |
| 4,917,532 | A | 4/1990 | Haberhauer et al. |
| 4,920,626 | A | 5/1990 | Nimberger |
| 4,940,503 | A | 7/1990 | Lindgren et al. |
| 4,952,775 | A | 8/1990 | Yokoyama et al. |
| 4,953,335 | A | 9/1990 | Kawaguchi et al. |
| 4,988,131 | A | 1/1991 | Wilson et al. |
| 4,998,395 | A | 3/1991 | Bezner |
| 4,998,396 | A | 3/1991 | Palmersten |
| 5,003,016 | A | 3/1991 | Boeder |
| 5,016,413 | A | 5/1991 | Counihan |
| 5,029,425 | A | 7/1991 | Bogataj |
| 5,034,272 | A | 7/1991 | Lindgren et al. |
| 5,050,362 | A | 9/1991 | Tal et al. |
| 5,052,158 | A | 10/1991 | D'Luzansky |
| 5,058,333 | A | 10/1991 | Schwartz |
| 5,070,662 | A | 12/1991 | Niese |
| 5,074,089 | A | 12/1991 | Kemmer et al. |
| 5,086,599 | A | 2/1992 | Meyerson |
| 5,092,095 | A | 3/1992 | Zadok |
| 5,102,253 | A | 4/1992 | Conti |
| 5,109,898 | A | 5/1992 | Schacht |
| 5,113,632 | A | 5/1992 | Hanson |
| 5,117,603 | A | 6/1992 | Weintraub |
| 5,138,812 | A | 8/1992 | Palmersten |
| 5,148,850 | A | 9/1992 | Urbanick |
| 5,155,952 | A | 10/1992 | Herwegh et al. |
| 5,157,890 | A | 10/1992 | Jines |
| 5,165,816 | A | 11/1992 | Parasin |
| 5,179,811 | A | 1/1993 | Walker et al. |
| 5,179,812 | A | 1/1993 | Hill |
| 5,182,892 | A | 2/1993 | Chase |
| 5,215,802 | A | 6/1993 | Kaars Sijpesteijn |
| 5,216,861 | A | 6/1993 | Meyerson |
| 5,244,303 | A | 9/1993 | Hair |
| 5,247,773 | A | 9/1993 | Weir |
| 5,253,464 | A | 10/1993 | Nilsen |
| 5,259,162 | A | 11/1993 | Nicholas |
| 5,266,384 | A | 11/1993 | O'Dell et al. |
| 5,271,564 | A | 12/1993 | Smith |
| 5,274,979 | A | 1/1994 | Tsai |
| 5,283,102 | A | 2/1994 | Sweet et al. |
| 5,292,155 | A | 3/1994 | Bell et al. |
| 5,295,341 | A | 3/1994 | Kajiwara |
| 5,313,751 | A | 5/1994 | Wittler |
| 5,325,649 | A | 7/1994 | Kajiwara |
| 5,343,665 | A | 9/1994 | Palmersten |
| 5,344,700 | A | 9/1994 | McGath et al. |
| 5,348,778 | A | 9/1994 | Knipp et al. |
| 5,349,796 | A | 9/1994 | Meyerson |
| 5,359,817 | A | 11/1994 | Fulton |
| 5,365,713 | A | 11/1994 | Nicholas et al. |
| 5,390,457 | A | 2/1995 | Sjolander |
| 5,413,840 | A | 5/1995 | Mizuno |
| 5,424,118 | A | 6/1995 | McLaughlin |
| 5,425,302 | A | 6/1995 | Levrai et al. |
| 5,433,048 | A | 7/1995 | Strasser |
| 5,433,806 | A | 7/1995 | Pasquali et al. |
| 5,437,934 | A | 8/1995 | Witt et al. |
| 5,474,831 | A | 12/1995 | Nystrom |
| 5,497,589 | A | 3/1996 | Porter |
| 5,502,939 | A | 4/1996 | Zadok et al. |
| 5,526,857 | A | 6/1996 | Forman |
| 5,527,128 | A | 6/1996 | Rope et al. |
| 5,540,025 | A | 7/1996 | Takehara et al. |
| D373,203 | S | 8/1996 | Kornfalt |
| 5,555,980 | A | 9/1996 | Johnston et al. |
| 5,566,519 | A | 10/1996 | Almaraz-Miera |
| 5,567,497 | A | 10/1996 | Zegler et al. |
| 5,570,554 | A | 11/1996 | Searer |
| 5,581,967 | A | 12/1996 | Glatz |
| 5,597,024 | A | 1/1997 | Bolyard et al. |
| 5,618,602 | A | 4/1997 | Nelson |
| 5,618,612 | A | 4/1997 | Gstrein |
| 5,623,799 | A | 4/1997 | Kowalski |
| 5,630,304 | A | 5/1997 | Austin |
| 5,647,181 | A | 7/1997 | Hunts |
| 5,657,598 | A | 8/1997 | Wilbs et al. |
| 5,671,575 | A | 9/1997 | Wu |
| 5,685,117 | A | 11/1997 | Nicholson |
| 5,688,569 | A | 11/1997 | Gilmore et al. |
| 5,692,354 | A | 12/1997 | Searer |
| 5,695,875 | A | 12/1997 | Larsson et al. |
| 5,706,621 | A | 1/1998 | Pervan |
| 5,706,623 | A | 1/1998 | Brown |
| 5,719,239 | A | 2/1998 | Mirous et al. |
| 5,735,092 | A | 4/1998 | Clayton et al. |
| 5,736,227 | A | 4/1998 | Sweet et al. |
| 5,755,068 | A | 5/1998 | Ormiston |
| 5,765,808 | A | 6/1998 | Butschbacher et al. |
| 5,768,850 | A | 6/1998 | Chen |
| 5,791,114 | A | 8/1998 | Mandel |
| 5,797,237 | A | 8/1998 | Finkell, Jr. |
| 5,823,240 | A | 10/1998 | Bolyard et al. |

(56) References Cited

U.S. PATENT DOCUMENTS

| | | | |
|---|---|---|---|
| 5,827,592 | A | 10/1998 | Van Gulik et al. |
| 5,860,267 | A | 1/1999 | Pervan |
| D406,360 | S | 3/1999 | Finkell, Jr. |
| 5,888,017 | A | 3/1999 | Corrie |
| 5,894,701 | A | 4/1999 | Delorme |
| 5,904,019 | A | 5/1999 | Kooij et al. |
| 5,907,934 | A | 6/1999 | Austin |
| 5,930,947 | A | 8/1999 | Eckhoff |
| 5,931,447 | A | 8/1999 | Butschbacher et al. |
| 5,935,668 | A | 8/1999 | Smith |
| 5,937,612 | A | 8/1999 | Winer et al. |
| 5,941,047 | A | 8/1999 | Johansson |
| 5,943,239 | A | 8/1999 | Shamblin et al. |
| 5,945,181 | A | 8/1999 | Fisher |
| 5,950,389 | A | 9/1999 | Porter |
| 5,968,625 | A | 10/1999 | Hudson |
| 5,971,655 | A | 10/1999 | Shirakawa |
| 5,987,839 | A | 11/1999 | Hamar et al. |
| 5,987,845 | A | 11/1999 | Laronde |
| 5,996,301 | A | 12/1999 | Conterno |
| 6,006,486 | A | 12/1999 | Moriau et al. |
| 6,012,263 | A | 1/2000 | Church et al. |
| 6,021,615 | A | 2/2000 | Brown |
| 6,021,646 | A | 2/2000 | Burley |
| 6,023,907 | A | 2/2000 | Pervan |
| 6,029,416 | A | 2/2000 | Andersson |
| 6,079,182 | A | 6/2000 | Ellenberger |
| 6,094,882 | A | 8/2000 | Pervan |
| 6,098,365 | A | 8/2000 | Martin et al. |
| 6,101,778 | A | 8/2000 | Martensson |
| 6,106,654 | A | 8/2000 | Velin et al. |
| 6,119,423 | A | 9/2000 | Costantino |
| 6,122,879 | A | 9/2000 | Montes |
| 6,134,854 | A | 10/2000 | Stanchfield |
| 6,141,920 | A | 11/2000 | Kemper |
| 6,143,119 | A | 11/2000 | Seidner |
| 6,148,884 | A | 11/2000 | Bolyard et al. |
| 6,158,915 | A | 12/2000 | Kise |
| 6,164,031 | A | 12/2000 | Counihan |
| 6,182,410 | B1 | 2/2001 | Pervan |
| 6,182,413 | B1 | 2/2001 | Magnusson |
| 6,189,283 | B1 | 2/2001 | Bentley |
| 6,205,639 | B1 | 3/2001 | Pervan |
| 6,209,278 | B1 | 4/2001 | Tychsen |
| 6,216,403 | B1 | 4/2001 | Belbeoc'h |
| 6,216,409 | B1 | 4/2001 | Roy et al. |
| 6,219,982 | B1 | 4/2001 | Eyring |
| 6,230,385 | B1 | 5/2001 | Nelson |
| 6,233,899 | B1 | 5/2001 | Mellert et al. |
| 6,247,285 | B1 | 6/2001 | Moebus |
| 6,253,514 | B1 | 7/2001 | Jobe et al. |
| 6,271,156 | B1 | 8/2001 | Gleason et al. |
| 6,314,701 | B1 | 11/2001 | Meyerson |
| 6,321,499 | B1 | 11/2001 | Chuang |
| 6,324,796 | B1 | 12/2001 | Heath |
| 6,324,803 | B1 | 12/2001 | Pervan |
| 6,324,809 | B1 | 12/2001 | Nelson |
| 6,332,733 | B1 | 12/2001 | Hamberger et al. |
| 6,345,480 | B1 | 2/2002 | Kemper |
| 6,345,481 | B1 | 2/2002 | Nelson |
| 6,346,861 | B2 | 2/2002 | Kim et al. |
| 6,363,677 | B1 | 4/2002 | Chen et al. |
| 6,363,678 | B1 | 4/2002 | Shuler |
| 6,365,258 | B1 | 4/2002 | Alm |
| 6,385,936 | B1 | 5/2002 | Schneider |
| 6,397,547 | B1 | 6/2002 | Martensson |
| 6,404,240 | B1 | 6/2002 | Hakkal et al. |
| 6,418,683 | B1 | 7/2002 | Martensson et al. |
| 6,421,970 | B1 | 7/2002 | Martensson et al. |
| 6,423,257 | B1 | 7/2002 | Stobart |
| 6,437,616 | B1 | 8/2002 | Antone et al. |
| 6,438,919 | B1 | 8/2002 | Knauseder |
| 6,446,405 | B1 | 9/2002 | Pervan |
| 6,497,079 | B1 | 12/2002 | Pletzer et al. |
| 6,505,452 | B1 | 1/2003 | Hannig et al. |
| 6,510,665 | B2 | 1/2003 | Pervan |
| 6,516,579 | B1 | 2/2003 | Pervan |
| 6,517,935 | B1 | 2/2003 | Kornfalt et al. |
| 6,521,314 | B2 | 2/2003 | Tychsen |
| 6,526,719 | B2 | 3/2003 | Pletzer et al. |
| 6,532,709 | B2 | 3/2003 | Pervan |
| 6,536,178 | B1 | 3/2003 | Palsson |
| 6,546,691 | B2 | 4/2003 | Leopolder |
| 6,550,205 | B2 | 4/2003 | Neuhofer |
| 6,551,007 | B2 | 4/2003 | Lichtenberg et al. |
| 6,588,165 | B1 | 7/2003 | Wright |
| 6,588,166 | B2 | 7/2003 | Martensson et al. |
| 6,591,568 | B1 | 7/2003 | Palsson |
| 6,601,359 | B2 | 8/2003 | Olofsson |
| 6,606,834 | B2 | 8/2003 | Martensson et al. |
| 6,617,009 | B1 | 9/2003 | Chen et al. |
| 6,647,689 | B2 | 11/2003 | Pletzer et al. |
| 6,647,690 | B1 | 11/2003 | Martensson |
| 6,670,019 | B2 | 12/2003 | Andersson |
| 6,672,030 | B2 | 1/2004 | Schulte |
| 6,681,820 | B2 | 1/2004 | Olofsson |
| 6,682,254 | B1 | 1/2004 | Olofsson |
| 6,685,391 | B1 | 2/2004 | Gideon |
| 6,711,869 | B2 | 3/2004 | Tychsem |
| 6,729,091 | B1 | 5/2004 | Martensson |
| 6,745,534 | B2 | 6/2004 | Kornfalt |
| 6,763,643 | B1 | 7/2004 | Martensson |
| 6,769,217 | B2 | 8/2004 | Nelson |
| 6,769,219 | B2 | 8/2004 | Schwitte et al. |
| 6,769,835 | B2 | 8/2004 | Stridsman |
| 6,786,016 | B1 | 9/2004 | Wood |
| 6,802,166 | B1 | 10/2004 | Gerhard |
| 6,804,926 | B1 | 10/2004 | Eisermann |
| 6,805,951 | B2 | 10/2004 | Kornfalt et al. |
| 6,851,237 | B2 | 2/2005 | Niese et al. |
| 6,851,241 | B2 | 2/2005 | Pervan |
| 6,854,235 | B2 | 2/2005 | Martensson |
| 6,860,074 | B2 | 3/2005 | Stanchfield |
| 6,862,857 | B2 | 3/2005 | Tychsen |
| 6,865,855 | B2 | 3/2005 | Knauseder |
| 6,880,305 | B2 | 4/2005 | Pervan et al. |
| 6,880,307 | B2 | 4/2005 | Schwitte et al. |
| 6,898,913 | B2 | 5/2005 | Pervan |
| 6,918,220 | B2 | 7/2005 | Pervan |
| 6,920,732 | B2 | 7/2005 | Martensson |
| 6,922,964 | B2 | 8/2005 | Pervan |
| 6,931,798 | B1 | 8/2005 | Pocai |
| 6,966,161 | B2 | 11/2005 | Palsson et al. |
| RE38,950 | E | 1/2006 | Maiers et al. |
| 7,003,924 | B2 | 2/2006 | Kettler et al. |
| 7,015,727 | B2 | 3/2006 | Balasubramanian |
| 7,021,019 | B2 | 4/2006 | Knauseder |
| 7,086,205 | B2 | 8/2006 | Pervan |
| 7,121,058 | B2 | 10/2006 | Palsson et al. |
| 7,121,059 | B2 | 10/2006 | Pervan |
| 7,131,242 | B2 | 11/2006 | Martensson |
| 7,146,772 | B2 | 12/2006 | Ralf |
| 7,152,507 | B2 | 12/2006 | Solari |
| 7,188,456 | B2 | 3/2007 | Knauseder |
| 7,210,272 | B2 | 5/2007 | Friday |
| 7,251,916 | B2 | 8/2007 | Konzelmann et al. |
| 7,332,053 | B2 | 2/2008 | Palsson et al. |
| 7,337,588 | B1 | 3/2008 | Moebus |
| 7,347,328 | B2 | 3/2008 | Hartwall |
| 7,377,081 | B2 | 5/2008 | Ruhdorfer |
| 7,398,628 | B2 | 7/2008 | Van Horne |
| 7,441,385 | B2 | 10/2008 | Palsson et al. |
| 7,444,791 | B1 | 11/2008 | Pervan |
| 7,451,578 | B2 | 11/2008 | Hannig |
| 7,484,337 | B2 | 2/2009 | Hecht |
| 7,497,058 | B2 | 3/2009 | Martensson |
| 7,552,568 | B2 | 6/2009 | Palsson et al. |
| 7,603,826 | B1 | 10/2009 | Moebus |
| 7,614,197 | B2 | 11/2009 | Nelson |
| 7,617,651 | B2 | 11/2009 | Grafenauer |
| 7,634,884 | B2 | 12/2009 | Pervan et al. |
| 7,665,267 | B2 | 2/2010 | Moriau et al. |
| 7,726,088 | B2 | 6/2010 | Muehleback |
| 7,820,287 | B2 | 10/2010 | Kornfalt et al. |

(56) References Cited

U.S. PATENT DOCUMENTS

| | | | |
|---|---|---|---|
| 7,841,144 | B2 | 11/2010 | Pervan |
| 7,856,784 | B2 | 12/2010 | Martensson |
| 7,856,785 | B2 | 12/2010 | Pervan |
| 7,856,789 | B2 | 12/2010 | Eisermann |
| 7,877,956 | B2 | 2/2011 | Martensson |
| 7,896,571 | B1 | 3/2011 | Hannig et al. |
| 7,980,039 | B2 | 7/2011 | Groeke et al. |
| 7,980,043 | B2 | 7/2011 | Moebus |
| 8,006,458 | B1 | 8/2011 | Olofsson et al. |
| 8,028,486 | B2 | 10/2011 | Pervan et al. |
| 8,037,657 | B2 | 10/2011 | Sjoberg et al. |
| 8,038,363 | B2 | 10/2011 | Hannig et al. |
| 8,117,795 | B2 | 2/2012 | Knauseder |
| 8,146,318 | B2 | 4/2012 | Palsson |
| 8,234,834 | B2 | 8/2012 | Martensson et al. |
| 8,276,342 | B2 | 10/2012 | Martensson |
| 8,402,709 | B2 | 3/2013 | Martensson |
| 8,429,869 | B2 | 4/2013 | Pervan |
| 8,516,767 | B2 | 8/2013 | Engstrom |
| 8,544,233 | B2 | 10/2013 | Palsson |
| 8,578,675 | B2 | 11/2013 | Palsson |
| 8,615,952 | B2 | 12/2013 | Engstrom |
| 8,631,623 | B2 | 1/2014 | Engstrom |
| 8,661,762 | B2 | 3/2014 | Martensson et al. |
| 8,720,148 | B2 | 5/2014 | Engstrom |
| 8,789,334 | B2 | 7/2014 | Moriau et al. |
| 8,875,465 | B2 | 11/2014 | Mårtensson |
| 8,978,334 | B2 | 3/2015 | Engstrom |
| 9,032,685 | B2 | 5/2015 | Martensson et al. |
| 2001/0024707 | A1 | 9/2001 | Andersson et al. |
| 2001/0029720 | A1 | 10/2001 | Pervan |
| 2002/0007608 | A1 | 1/2002 | Pervan |
| 2002/0046526 | A1 | 4/2002 | Knauseder |
| 2002/0046528 | A1 | 4/2002 | Pervan et al. |
| 2002/0095895 | A1 | 7/2002 | Daly et al. |
| 2002/0100242 | A1 | 8/2002 | Olofsson |
| 2002/0112433 | A1 | 8/2002 | Pervan |
| 2002/0127374 | A1 | 9/2002 | Spratling |
| 2002/0148551 | A1 | 10/2002 | Knauseder |
| 2002/0178674 | A1 | 12/2002 | Pervan |
| 2002/0178681 | A1 | 12/2002 | Zancai et al. |
| 2002/0178682 | A1 | 12/2002 | Pervan |
| 2002/0189183 | A1 | 12/2002 | Ricciardelli |
| 2002/0189747 | A1 | 12/2002 | Steinwender |
| 2003/0009971 | A1 | 1/2003 | Palmberg |
| 2003/0009972 | A1 | 1/2003 | Pervan et al. |
| 2003/0024199 | A1 | 2/2003 | Pervan et al. |
| 2003/0024200 | A1 | 2/2003 | Moriau et al. |
| 2003/0033784 | A1 | 2/2003 | Pervan |
| 2003/0084634 | A1 | 5/2003 | Stanchfield |
| 2003/0084636 | A1 | 5/2003 | Pervan |
| 2003/0094230 | A1 | 5/2003 | Sjoberg |
| 2003/0112913 | A1 | 6/2003 | Balasubramanian |
| 2003/0118812 | A1 | 6/2003 | Kornfalt |
| 2003/0141004 | A1 | 7/2003 | Palmblad |
| 2003/0145540 | A1 | 8/2003 | Brunedal |
| 2003/0154678 | A1 | 8/2003 | Stanchfield |
| 2003/0159389 | A1 | 8/2003 | Kornfalt |
| 2003/0224147 | A1 | 12/2003 | Maine et al. |
| 2004/0016197 | A1 | 1/2004 | Ruhdorfer |
| 2004/0031225 | A1 | 2/2004 | Fowler |
| 2004/0031226 | A1 | 2/2004 | Miller |
| 2004/0031227 | A1 | 2/2004 | Knauseder |
| 2004/0035077 | A1 | 2/2004 | Martensson et al. |
| 2004/0040235 | A1 | 3/2004 | Kurtz |
| 2004/0041225 | A1 | 3/2004 | Nemoto |
| 2004/0139678 | A1 | 7/2004 | Pervan |
| 2004/0182036 | A1 | 9/2004 | Sjoberg et al. |
| 2004/0191461 | A1 | 9/2004 | Riccobene |
| 2004/0211143 | A1 | 10/2004 | Hanning |
| 2004/0211144 | A1 | 10/2004 | Stanchfield |
| 2004/0250492 | A1 | 12/2004 | Becker |
| 2005/0034405 | A1 | 2/2005 | Pervan |
| 2005/0144881 | A1 | 7/2005 | Tate |
| 2005/0166526 | A1 | 8/2005 | Stanchfield |
| 2005/0210810 | A1 | 9/2005 | Pervan |
| 2005/0252130 | A1 | 11/2005 | Martensson |
| 2006/0101769 | A1 | 5/2006 | Pervan et al. |
| 2006/0236642 | A1 | 10/2006 | Pervan |
| 2006/0248836 | A1 | 11/2006 | Martensson |
| 2007/0006543 | A1 | 1/2007 | Engstrom |
| 2007/0028547 | A1 | 2/2007 | Grafenauer et al. |
| 2007/0240376 | A1 | 10/2007 | Engstrom |
| 2008/0000286 | A1 | 1/2008 | Strohmaier et al. |
| 2008/0134607 | A1* | 6/2008 | Pervan et al. ..... 52/395 |
| 2008/0134613 | A1 | 6/2008 | Pervan |
| 2008/0216434 | A1 | 9/2008 | Pervan |
| 2008/0236088 | A1 | 10/2008 | Hannig |
| 2008/0271403 | A1 | 11/2008 | Palsson |
| 2009/0019806 | A1 | 1/2009 | Muehlebach |
| 2009/0064624 | A1 | 3/2009 | Sokol |
| 2009/0100782 | A1 | 4/2009 | Groeke et al. |
| 2009/0193748 | A1 | 8/2009 | Boo et al. |
| 2009/0199500 | A1 | 8/2009 | LeBlang |
| 2009/0217615 | A1 | 9/2009 | Engstrom |
| 2009/0249733 | A1 | 10/2009 | Moebus |
| 2010/0031599 | A1 | 2/2010 | Kennedy et al. |
| 2010/0043333 | A1 | 2/2010 | Hannig |
| 2010/0058700 | A1 | 3/2010 | LeBlang |
| 2010/0236707 | A1 | 9/2010 | Studer et al. |
| 2011/0078977 | A1 | 4/2011 | Martensson |
| 2011/0167751 | A1 | 7/2011 | Engstrom |
| 2011/0173914 | A1 | 7/2011 | Engstrom |
| 2011/0185663 | A1 | 8/2011 | Martensson |
| 2011/0225922 | A1 | 9/2011 | Pervan et al. |
| 2011/0271631 | A1 | 11/2011 | Engstrom |
| 2011/0271632 | A1 | 11/2011 | Cappelle et al. |
| 2011/0293361 | A1 | 12/2011 | Olofsson |
| 2012/0042595 | A1 | 2/2012 | De Boe |
| 2012/0055112 | A1 | 3/2012 | Engstrom |
| 2012/0216472 | A1 | 8/2012 | Martensson et al. |
| 2012/0233948 | A1 | 9/2012 | Palsson |
| 2012/0247053 | A1 | 10/2012 | Martensson |
| 2012/0291396 | A1 | 11/2012 | Martensson |
| 2012/0304590 | A1 | 12/2012 | Engstrom |
| 2013/0042555 | A1 | 2/2013 | Martensson |
| 2013/0067840 | A1 | 3/2013 | Martensson |
| 2013/0241103 | A1 | 9/2013 | Engstrom |
| 2013/0291467 | A1 | 11/2013 | Palsson et al. |
| 2014/0033630 | A1 | 2/2014 | Engstrom |
| 2014/0137506 | A1 | 5/2014 | Palsson |
| 2014/0157700 | A1 | 6/2014 | Martensson |
| 2014/0157711 | A1 | 6/2014 | Palsson et al. |
| 2014/0157721 | A1 | 6/2014 | Engstrom |
| 2014/0165493 | A1 | 6/2014 | Palsson et al. |
| 2015/0075105 | A1 | 3/2015 | Engstrom |

FOREIGN PATENT DOCUMENTS

| | | | |
|---|---|---|---|
| AU | 1309883 | A | 10/1983 |
| AU | 199732569 | | 12/1999 |
| AU | 200020703 | | 6/2000 |
| BE | 417526 | A | 12/1936 |
| BE | 556860 | A | 5/1957 |
| BE | 557844 | A | 3/1960 |
| BE | 765817 | A2 | 9/1971 |
| BE | 1010339 | A3 | 6/1998 |
| BE | 1010487 | A6 | 10/1998 |
| CA | 991373 | A1 | 6/1976 |
| CA | 1049736 | A1 | 3/1979 |
| CA | 1169106 | A1 | 6/1984 |
| CA | 1325873 | C | 1/1994 |
| CA | 2226286 | A1 | 12/1997 |
| CA | 2252791 | C | 5/1999 |
| CA | 2162836 | C | 6/1999 |
| CA | 2289309 | A1 | 11/1999 |
| CA | 2150384 | C | 4/2005 |
| CH | 200949 | A | 11/1938 |
| CH | 211677 | A | 10/1940 |
| CH | 211877 | A | 10/1940 |
| CH | 562 377 | A5 | 5/1975 |
| CH | 640455 | A5 | 1/1984 |
| CN | 1054215 | A | 9/1991 |
| CN | 2091909 | U | 1/1992 |

(56) References Cited

FOREIGN PATENT DOCUMENTS

| | | | |
|---|---|---|---|
| CN | 1115351 | A | 1/1996 |
| CN | 1124941 | A | 6/1996 |
| CN | 2242278 | Y | 12/1996 |
| DE | 209979 | C | 11/1906 |
| DE | 517353 | | 2/1931 |
| DE | 1212275 | B | 3/1966 |
| DE | 1934295 | U | 3/1966 |
| DE | 1985418 | U | 5/1968 |
| DE | 1534802 | A1 | 4/1970 |
| DE | 7102476 | | 6/1971 |
| DE | 1658875 | B1 | 9/1971 |
| DE | 2007129 | A1 | 9/1971 |
| DE | 1534278 | A1 | 11/1971 |
| DE | 2139283 | A1 | 2/1972 |
| DE | 2101782 | A1 | 7/1972 |
| DE | 2102537 | A1 | 8/1972 |
| DE | 2145024 | A1 | 3/1973 |
| DE | 2159042 | A1 | 6/1973 |
| DE | 2205232 | A1 | 8/1973 |
| DE | 2238660 | A1 | 2/1974 |
| DE | 2251762 | | 5/1974 |
| DE | 2252643 | A1 | 5/1974 |
| DE | 7402354 | | 5/1974 |
| DE | 2502992 | A1 | 7/1976 |
| DE | 2552622 | A1 | 5/1977 |
| DE | 2616077 | A1 | 10/1977 |
| DE | 2802151 | A1 | 7/1979 |
| DE | 2917025 | A1 | 11/1980 |
| DE | 2916482 | A1 | 12/1980 |
| DE | 2927425 | A1 | 1/1981 |
| DE | 3104519 | | 2/1981 |
| DE | 2940945 | A1 | 4/1981 |
| DE | 3041781 | A1 | 6/1982 |
| DE | 3046618 | A1 | 7/1982 |
| DE | 3117605 | A1 | 11/1982 |
| DE | 3214207 | | 11/1982 |
| DE | 3246376 | | 6/1984 |
| DE | 3304992 | | 8/1984 |
| DE | 3306609 | | 9/1984 |
| DE | 3319235 | | 11/1984 |
| DE | 3343601 | | 6/1985 |
| DE | 3412882 | A1 | 10/1985 |
| DE | 8600241 | U1 | 4/1986 |
| DE | 8604004 | | 4/1986 |
| DE | 3512204 | | 10/1986 |
| DE | 3544845 | | 6/1987 |
| DE | 3631390 | | 12/1987 |
| DE | 3640822 | | 6/1988 |
| DE | 3741041 | A1 | 9/1988 |
| DE | 3933611 | A1 | 4/1991 |
| DE | 4105207 | A1 | 8/1991 |
| DE | 40025470 | | 8/1991 |
| DE | 3932980 | | 11/1991 |
| DE | 4130115 | A1 | 3/1993 |
| DE | 9300306 | | 3/1993 |
| DE | 4134452 | | 4/1993 |
| DE | 4215273 | | 11/1993 |
| DE | 4242530 | | 6/1994 |
| DE | 4344 089 | | 7/1994 |
| DE | 4313037 | C1 | 8/1994 |
| DE | 9317191 | | 3/1995 |
| DE | 4402352 | A1 | 8/1995 |
| DE | 19503948 | A1 | 8/1996 |
| DE | 29520966 | U1 | 8/1996 |
| DE | 29614 086 | | 10/1996 |
| DE | 19601322 | A1 | 5/1997 |
| DE | 29703962 | | 6/1997 |
| DE | 29710175 | | 8/1997 |
| DE | 29711960 | | 10/1997 |
| DE | 19651149 | | 6/1998 |
| DE | 19704292 | A1 | 8/1998 |
| DE | 19709641 | | 9/1998 |
| DE | 19718319 | A1 | 11/1998 |
| DE | 19821938 | | 11/1999 |
| DE | 19851200 | C1 | 3/2000 |
| DE | 20001225 | | 7/2000 |
| DE | 19940837 | A1 | 11/2000 |
| DE | 19925248 | | 12/2000 |
| DE | 20018284 | | 1/2001 |
| DE | 19933343 | A1 | 2/2001 |
| DE | 20017461 | | 2/2001 |
| DE | 20027461 | | 3/2001 |
| DE | 19963203 | A1 | 9/2001 |
| DE | 10001076 | | 10/2001 |
| DE | 20203311 | U1 | 5/2002 |
| DE | 10062873 | | 7/2002 |
| DE | 10120062 | A1 | 11/2002 |
| DE | 10131248 | | 1/2003 |
| DE | 10242647 | A1 | 6/2004 |
| DE | 10 2005 002 297.9 | | 8/2005 |
| DE | 10 2007 035 648 | | 1/2009 |
| DE | 2009022483.1 | | 5/2009 |
| DE | 20 2009 004 530 | | 6/2009 |
| DE | 10 2010 020 089.1 | | 5/2010 |
| DE | 10 2009 038 750 | | 3/2011 |
| DE | 10 2010 004717.1 | | 7/2011 |
| DE | 20 2004 021 867 | | 2/2012 |
| EP | 0024360 | A1 | 3/1981 |
| EP | 0044371 | A1 | 1/1982 |
| EP | 0085196 | | 8/1983 |
| EP | 0117707 | A2 | 9/1984 |
| EP | 0161233 | A1 | 11/1985 |
| EP | 0196672 | A2 | 10/1986 |
| EP | 0220389 | A2 | 5/1987 |
| EP | 0248127 | | 12/1987 |
| EP | 0256189 | A1 | 2/1988 |
| EP | 0279278 | A2 | 8/1988 |
| EP | 0335778 | A2 | 10/1989 |
| EP | 0401146 | A1 | 12/1990 |
| EP | 0487925 | A1 | 6/1992 |
| EP | 0508083 | A1 | 10/1992 |
| EP | 0508260 | A2 | 10/1992 |
| EP | 0562402 | A1 | 9/1993 |
| EP | 0604896 | A1 | 7/1994 |
| EP | 0623724 | | 11/1994 |
| EP | 0652332 | A1 | 5/1995 |
| EP | 0652340 | | 5/1995 |
| EP | 0690185 | A1 | 1/1996 |
| EP | 000711886 | | 5/1996 |
| EP | 0715037 | A1 | 6/1996 |
| EP | 0799679 | A2 | 10/1997 |
| EP | 0813641 | A1 | 12/1997 |
| EP | 0843763 | | 5/1998 |
| EP | 0849416 | | 6/1998 |
| EP | 0855482 | | 7/1998 |
| EP | 0877130 | | 11/1998 |
| EP | 0903451 | | 3/1999 |
| EP | 0906994 | A1 | 4/1999 |
| EP | 0958441 | | 11/1999 |
| EP | 0969163 | | 1/2000 |
| EP | 0969164 | | 1/2000 |
| EP | 0974713 | | 1/2000 |
| EP | 1045083 | A1 | 10/2000 |
| EP | 1120515 | A1 | 8/2001 |
| EP | 1146182 | A2 | 10/2001 |
| EP | 1229181 | | 8/2002 |
| EP | 1262608 | A2 | 12/2002 |
| EP | 1279778 | A2 | 1/2003 |
| EP | 1308577 | A2 | 5/2003 |
| EP | 1350904 | A2 | 10/2003 |
| EP | 1359266 | A2 | 11/2003 |
| EP | 1367194 | A2 | 12/2003 |
| EP | 1420125 | A2 | 5/2004 |
| EP | 1437457 | A2 | 7/2004 |
| EP | 2400076 | | 8/2004 |
| EP | 2034106 | | 3/2009 |
| FI | 843060 | | 8/1984 |
| FR | 557844 | | 8/1923 |
| FR | 1175582 | | 3/1959 |
| FR | 1215852 | | 4/1960 |
| FR | 1293043 | | 5/1962 |
| FR | 1372596 | A | 9/1964 |
| FR | 1511292 | A | 1/1968 |
| FR | 2209024 | A1 | 6/1974 |

(56) References Cited

FOREIGN PATENT DOCUMENTS

| | | | |
|---|---|---|---|
| FR | 2268922 | A1 | 11/1975 |
| FR | 2278876 | A1 | 2/1976 |
| FR | 2345560 | A1 | 10/1977 |
| FR | 2362254 | A1 | 3/1978 |
| FR | 2416988 | A1 | 9/1979 |
| FR | 2445874 | A1 | 8/1980 |
| FR | 2568295 | | 1/1986 |
| FR | 2630149 | | 10/1989 |
| FR | 2637932 | | 4/1990 |
| FR | 2675174 | | 10/1992 |
| FR | 2691491 | | 11/1993 |
| FR | 2691691 | | 12/1993 |
| FR | 2697275 | | 4/1994 |
| FR | 2712329 | | 5/1995 |
| FR | 2781513 | | 1/2000 |
| FR | 2785633 | | 5/2000 |
| FR | 2810060 | | 12/2001 |
| FR | 2891491 | A1 | 4/2007 |
| GB | 240629 | A | 10/1925 |
| GB | 356270 | A | 9/1931 |
| GB | 424057 | | 2/1935 |
| GB | 448329 | A | 6/1936 |
| GB | 471438 | A | 9/1937 |
| GB | 585205 | | 1/1947 |
| GB | 589635 | A | 6/1947 |
| GB | 599793 | | 3/1948 |
| GB | 636423 | | 4/1950 |
| GB | 647812 | A | 12/1950 |
| GB | 812671 | | 4/1959 |
| GB | 875327 | A | 8/1961 |
| GB | 1027709 | A | 4/1966 |
| GB | 1039949 | A | 8/1966 |
| GB | 1127915 | A | 9/1968 |
| GB | 1161838 | A | 8/1969 |
| GB | 1171337 | A | 11/1969 |
| GB | 1183401 | A | 3/1970 |
| GB | 1191656 | A | 5/1970 |
| GB | 1212983 | | 11/1970 |
| GB | 1237744 | | 6/1971 |
| GB | 1275511 | A | 5/1972 |
| GB | 1308011 | A | 2/1973 |
| GB | 1348272 | | 3/1974 |
| GB | 1430423 | | 3/1976 |
| GB | 1445687 | A | 8/1976 |
| GB | 1485419 | A | 9/1977 |
| GB | 2117813 | | 10/1983 |
| GB | 2124672 | A | 2/1984 |
| GB | 2126106 | | 3/1984 |
| GB | 2142670 | | 1/1985 |
| GB | 2168732 | | 6/1986 |
| GB | 2167465 | | 1/1989 |
| GB | 2221740 | A | 2/1990 |
| GB | 2228753 | | 9/1990 |
| GB | 2240039 | A | 7/1991 |
| GB | 2243381 | | 10/1991 |
| GB | 2256023 | | 11/1992 |
| GB | 2325342 | A | 11/1998 |
| GB | 2365880 | A | 2/2002 |
| IT | 444123 | | 1/1949 |
| IT | 812671 | | 4/1959 |
| JP | 5465528 | | 5/1979 |
| JP | 57119056 | | 7/1982 |
| JP | 59041560 | A | 3/1984 |
| JP | 59186336 | | 12/1984 |
| JP | S6414838 | A | 1/1989 |
| JP | S6414839 | U | 1/1989 |
| JP | 1178659 | | 7/1989 |
| JP | H 01178659 | A | 7/1989 |
| JP | H 02285145 | A | 11/1990 |
| JP | H 03318343 | U | 2/1991 |
| JP | 3046645 | | 4/1991 |
| JP | H 0344645 | | 4/1991 |
| JP | 3110258 | | 5/1991 |
| JP | 3169967 | | 7/1991 |
| JP | 3202550 | | 9/1991 |
| JP | 4106264 | | 4/1992 |
| JP | 4191001 | | 7/1992 |
| JP | H 04191001 | A | 7/1992 |
| JP | 04261955 | A | 9/1992 |
| JP | H 0518028 | A | 1/1993 |
| JP | 5148984 | | 6/1993 |
| JP | 6146553 | | 5/1994 |
| JP | 6200611 | A | 7/1994 |
| JP | H 0656310 | U | 8/1994 |
| JP | 6315944 | A | 11/1994 |
| JP | 6320510 | | 11/1994 |
| JP | 407052103 | | 2/1995 |
| JP | H 0 752103 | A | 2/1995 |
| JP | 7076923 | | 3/1995 |
| JP | 7180333 | | 7/1995 |
| JP | 7189466 | A | 7/1995 |
| JP | 7229276 | | 8/1995 |
| JP | H 07229276 | A | 8/1995 |
| JP | 7279366 | | 10/1995 |
| JP | H 07279366 | A | 10/1995 |
| JP | 7300979 | | 11/1995 |
| JP | 7310426 | | 11/1995 |
| JP | 961207 | | 2/1996 |
| JP | H 0874405 | A | 3/1996 |
| JP | 8086078 | | 4/1996 |
| JP | 8109734 | A | 4/1996 |
| JP | H 0876078 | A | 4/1996 |
| JP | 8270193 | A | 10/1996 |
| JP | H 08268344 | A | 10/1996 |
| JP | H 0938906 | A | 2/1997 |
| JP | H 0988315 | A | 3/1997 |
| JP | H 09256603 | A | 9/1997 |
| JP | H 10219975 | A | 8/1998 |
| JP | 5154806 | B2 | 8/2008 |
| JP | 4203141 | B2 | 12/2008 |
| JP | 5304714 | B2 | 10/2013 |
| KR | 9533446 | A | 12/1995 |
| NL | 7601773 | | 2/1975 |
| NO | 157871 | | 7/1984 |
| NO | 305614 | | 5/1995 |
| PL | 26931 | U1 | 6/1989 |
| SE | 372051 | | 12/1974 |
| SE | 7114900-9 | | 12/1974 |
| SE | 7706470 | | 12/1978 |
| SE | 450141 | | 6/1987 |
| SE | 8206934-5 | | 6/1987 |
| SE | 457737 | | 1/1989 |
| SE | 462809 | | 4/1990 |
| SE | 467150 | | 6/1992 |
| SE | 501014 | | 10/1994 |
| SE | 9301595-6 | | 10/1994 |
| SE | 9500810 | | 3/1995 |
| SE | 502994 | | 3/1996 |
| SE | 503861 | | 9/1996 |
| SE | 509059 | | 11/1998 |
| SE | 509060 | | 11/1998 |
| SE | 512290 | | 2/2000 |
| SE | 512313 | | 2/2000 |
| SE | 513189 | | 7/2000 |
| SE | 514645 | | 3/2001 |
| SE | 0001149 | | 10/2001 |
| SU | 363795 | A1 | 1/1973 |
| SU | 857393 | A1 | 8/1981 |
| WO | WO 80/02155 | | 10/1980 |
| WO | WO 82/00313 | A1 | 2/1982 |
| WO | WO 84/02155 | A1 | 6/1984 |
| WO | WO 87/03839 | | 7/1987 |
| WO | WO 90/00656 | A1 | 1/1990 |
| WO | WO 92/12074 | A2 | 7/1992 |
| WO | WO 92/17657 | | 10/1992 |
| WO | WO 93/13280 | | 7/1993 |
| WO | WO 93/19910 | A1 | 10/1993 |
| WO | WO 94/01628 | | 1/1994 |
| WO | WO 94/04773 | A1 | 3/1994 |
| WO | WO 94/22678 | A1 | 10/1994 |
| WO | WO 94/26999 | | 11/1994 |
| WO | WO 95/05274 | A1 | 2/1995 |
| WO | WO 95/06176 | A1 | 3/1995 |
| WO | WO 95/14834 | A1 | 6/1995 |

(56) References Cited

FOREIGN PATENT DOCUMENTS

| | | | |
|---|---|---|---|
| WO | WO 96/12857 | | 5/1996 |
| WO | WO 96/23942 | | 8/1996 |
| WO | WO 96/27719 | | 9/1996 |
| WO | WO 96/27721 | | 9/1996 |
| WO | WO 96/30177 | | 10/1996 |
| WO | WO 97/47834 | | 12/1997 |
| WO | WO 98/22677 | A1 | 5/1998 |
| WO | WO 98/22678 | | 5/1998 |
| WO | WO 98/24994 | | 6/1998 |
| WO | WO 98/24995 | | 6/1998 |
| WO | WO 98/58142 | | 12/1998 |
| WO | WO 99/01628 | | 1/1999 |
| WO | WO 99/13179 | A1 | 3/1999 |
| WO | WO 99/40273 | | 8/1999 |
| WO | WO 99/66151 | | 12/1999 |
| WO | WO 99/66152 | | 12/1999 |
| WO | WO 00/06854 | | 2/2000 |
| WO | WO 00/20705 | | 4/2000 |
| WO | WO 00/20706 | A1 | 4/2000 |
| WO | WO-00/47841 | | 8/2000 |
| WO | WO 00/56802 | | 9/2000 |
| WO | WO 00/63510 | | 10/2000 |
| WO | WO 00/66856 | | 11/2000 |
| WO | WO 01/02669 | | 1/2001 |
| WO | WO 01/02670 | A1 | 1/2001 |
| WO | WO 01/02671 | A1 | 1/2001 |
| WO | WO 01/02672 | A1 | 1/2001 |
| WO | WO 01/07729 | A1 | 2/2001 |
| WO | WO 00/02214 | | 3/2001 |
| WO | WO 01/20101 | | 3/2001 |
| WO | WO 01/31141 | | 5/2001 |
| WO | WO 01/48332 | A1 | 7/2001 |
| WO | WO 01/51732 | | 7/2001 |
| WO | WO 01/51733 | | 7/2001 |
| WO | WO 01/53628 | A1 | 7/2001 |
| WO | WO 01/66877 | A1 | 9/2001 |
| WO | WO 01/75247 | | 10/2001 |
| WO | WO 01/77461 | A1 | 10/2001 |
| WO | WO 01/88306 | A1 | 11/2001 |
| WO | WO 01/88307 | A1 | 11/2001 |
| WO | WO 01/98604 | A1 | 12/2001 |
| WO | WO 02/055809 | A1 | 7/2002 |
| WO | WO 02/055810 | A1 | 7/2002 |
| WO | WO 02/081843 | | 10/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/074814 | A1 | 9/2003 |
| WO | WO 03/078761 | A1 | 9/2003 |
| WO | WO 03/083234 | | 10/2003 |
| WO | WO 03/087497 | A1 | 10/2003 |
| WO | WO 03/089736 | A1 | 10/2003 |
| WO | WO 03/093686 | | 11/2003 |
| WO | WO 2004/016877 | A1 | 2/2004 |
| WO | WO 2004/020764 | A1 | 3/2004 |
| WO | WO 2005/040521 | | 5/2005 |
| WO | WO 2005/054599 | A1 | 6/2005 |
| WO | WO 2005/059269 | | 6/2005 |
| WO | WO-2006/043893 | | 4/2006 |
| WO | WO 2007/008139 | | 1/2007 |
| WO | WO 2007/089186 | | 8/2007 |
| WO | WO 2007/141605 | A2 | 12/2007 |
| WO | WO 2008/004960 | | 1/2008 |
| WO | WO 2008/068245 | | 6/2008 |
| WO | WO 2009/066153 | | 5/2009 |
| WO | WO-2009/116926 | | 9/2009 |
| WO | WO 2009/139687 | | 11/2009 |
| WO | WO 2010/082171 | | 7/2010 |
| WO | WO-2010/108980 | | 9/2010 |
| WO | WO 2010/136171 | A1 | 12/2010 |
| WO | WO 2011/085788 | | 7/2011 |
| WO | WO-2011/085825 | | 7/2011 |
| WO | WO-2011/087425 | | 7/2011 |
| WO | WO-2011/096879 | | 8/2011 |
| WO | WO 2011/141043 | | 11/2011 |

OTHER PUBLICATIONS

Traditional Details; For Building Restoration, Renovation, and Rehabilitation: From the 1932-1951 Editions of Architectvral Graphic Standards; John Wiley & Sons, Inc.
Traindustrins Handbok "Snickeriarbete", Kunt Larsson, Tekno's Handbocker Publikation 12-11 (1952).
Elements of Rolling Practice; The United Steel Companies Limited Sheffield, England, 1963; pp. 116-117.
Die mobile; Terbrack; 1968.
High-Production Roll Forming; Society of Manufacturing Engineers Marketing Services Depmiment; pp. 189-192; George T. Halmos; 1983.
Fundamentals of Building Construction Materials and Methods; Copyright 1985; pp. 11. Automated Program of Designing Snap-fits; Aug. 1987; pp. 3.
Automated Program of Designing Snap-fits; Aug. 1987; pp. 3.
Plastic Part Technology; 1991; pp. 161-162.
Technoscope; Modern Plastics, Aug. 1991; pp. 29-30.
Encyclopedia of Wood Joints; A Fine Woodworking Book; pp. 1-151; 1992.
Patent Mit Inter-nationalem, Die Revolution ((von Grund auf)) Fibo-Trespo, Disstributed at the Domotex fair in Hannover, Germany in Jan. 1996.
U.S. Appl. No. 90/637,036, filed Oct. 2000, Pervan.
Focus, Information Till Ana Medabetare, Jan. 2001, Kahrs pa Domotex I Hmmover, Tysklm1d, Jan. 13-16, 2001.
Search Report dated Apr. 21, 2001.
Letter to the USPTO dated May 14, 2002, regarding U.S. Appl. No. 90/005,744.
Non-Final Office Action for U.S. Appl. No. 10/270,163 dated Dec. 10, 2004.
Final Office Action for U.S. Appl. No. 10/270,163 dated Jun. 2, 2005.
Non-Final Office Action for U.S. Appl. No. 10/015,741 dated Jun. 29, 2005.
Notice of Allowance for U.S. Appl. No. 10/015,741 dated Dec. 1, 2005.
Non-Final Office Action for U.S. Appl. No. 10/270,163 dated Dec. 14, 2005.
Final Office Action for U.S. Appl. No. 10/270,163 dated May 25, 2006.
Non-Final Office Action for U.S. Appl. No. 11/185,724 dated Sep. 26, 2006.
Non-Final Office Action for U.S. Appl. No. 11/483,636 dated Oct. 11, 2006.
Reexamination No. 90/007,366 dated Oct. 24, 2006.
Reexamination No. 90/007,526 dated Dec. 5, 2006.
Non-Final Office Action for U.S. Appl. No. 11/185,724 dated Apr. 19, 2007.
Non-Final Office Action for U.S. Appl. No. 11/483,636 dated Apr. 19, 2007.
Non-Final Office Action for U.S. Appl. No. 11/015,741 dated Sep. 6, 2007.
Non-Final Office Action for U.S. Appl. No. 11/242,127 dated Nov. 1, 2007.
Non-Final Office Action for U.S. Appl. No. 11/185,724 dated Jan. 9, 2008.
Final Office Action for U.S. Appl. No. 11/015,741 dated Feb. 26, 2008.
Non-Final Office Action for U.S. Appl. No. 11/483,636 dated Apr. 3, 2008.
Non-Final Office Action for U.S. Appl. No. 11/242,127 dated Apr. 29, 2008.
United States District Court Eastern District of Wisconsin; Order; Dated May 1, 2008.
Examiner Interview Summary for U.S. Appl. No. 11/015,741 dated May 7, 2008.
Final Office Action for U.S. Appl. No. 11/185,724 dated Jul 9, 2008.
Non-Final Office Action for U.S. Appl. No. 10/580,191 dated Jul. 16, 2008.
Reexamination No. 90/007,365 dated Aug. 5, 2008.

(56) References Cited

OTHER PUBLICATIONS

United States District Court Eastern District of Wisconsin; Judgement; Dated Oct. 10, 2008.
United States District Court Eastern District of Wisconsin; Order; Dated Oct. 10, 2008.
Final Office Action for U.S. Appl. No. 11/483,636 dated Nov. 20, 2008.
United States District Court Eastern District of Wisconsin; Order; Dated Dec. 31, 2008.
Non-Final Office Action for U.S. Appl. No. 11/242,127 dated Mar. 31, 2009.
Non-Final Office Action for U.S. Appl. No. 12/010,587 dated Jun. 23, 2009.
Non-Final Office Action for U.S. Appl. No. 11/483,636 dated Jul. 21, 2009.
Non-Final Office Action for U.S. Appl. No. 12/010,587 dated Oct. 10, 2012.
Examiner Interview Summary for U.S. Appl. No. 11/185,724 dated Aug. 13, 2009.
Non-Final Office Action for U.S. Appl. No. 12/278,274 dated Sep. 24, 2009.
Final Office Action for U.S. Appl. No. 11/242,127 dated Nov. 24, 2009.
United States Court of Appeals for Federal Circuit; 2009-1107,-1122; Decided: Feb. 18, 2010.
Appeals from the United States District Court for the Eastern District of Wisconsin; Consolidated case No. 02-CV-0736 and 03-CV-616; Judge J.P. Stadtmueller, 2009-1107,-1122. Revised Feb. 25, 2010.
Non-Final Office Action for U.S. Appl. No. 10/580,191 dated Mar. 10, 2010.
Non-Final Office Action for U.S. Appl. No. 11/483,636 dated Mar. 17, 2010.
United States Court of Appeals of the Federal Circuit; Case No. 02-CV-0736 and 03-CV-616; Mandate issued on Apr. 12, 2010; Judgement; 2 pages.
Final Office Action for U.S. Appl. No. 12/278,274 dated May 17, 2010.
Final Office Action for U.S. Appl. No. 12/010,587 dated May 25, 2010.
Advisory Action for U.S. Appl. No. 12/278,274 dated Sep. 27, 2010.
Final Office Action for U.S. Appl. No. 10/580,191 dated Oct. 6, 2010.
Non-Final Office Action for U.S. Appl. No. 12/278,274 dated Nov. 2, 2010.
Non-Final Office Action for U.S. Appl. No. 11/483,636 dated Dec. 7, 2010.
Advisory Action for U.S. Appl. No. 10/580,191 dated Feb. 15, 2011.
Non-Final Office Action for U.S. Appl. No. 12/010,587 dated Mar. 16, 2011.
International Search Report for Application No. PCT/EP2010/006772 dated Mar. 31, 2011.
Final Office Action for U.S. Appl. No. 12/278,274 dated Apr. 14, 2011.
Final Office Action for U.S. Appl. No. 11/483,636 dated May 24, 2011.
Non-Final Office Action for U.S. Appl. No. 13/048,646 dated May 25, 2011.
Non-Final Office Action for U.S. Appl. No. 12/966,861 dated Jul. 20, 2011.
Non-Final Office Action for U.S. Appl. No. 12/979,086 dated Aug. 3, 2011.
Non-Final Office Action for U.S. Appl. No. 12/010,587 dated Aug. 30, 2011.
Non-Final Office Action for U.S. Appl. No. 11/483,636 dated Sep. 28, 2011.
Decision revoking the European Patent EP-B-1 276 941 dated Oct. 21, 2011.
European Patent Office Opposition Division Decision for Application No. 01906461.7 dated Oct. 21, 2011.
Final Office Action for U.S. Appl. No. 13/048,646 dated Nov. 1, 2011.
Final Office Action for U.S. Appl. No. 12/966,861 dated Jan. 20, 2012.
Final Office Action for U.S. Appl. No. 12/979,086 dated Jan. 25, 2012.
Final Office Action for U.S. Appl. No. 11/483,636 dated Feb. 7, 2012.
Non-Final Office Action for U.S. Appl. No. 12/966,797 dated Feb. 29, 2012.
Final Office Action for U.S. Appl. No. 13/204,481 dated Mar. 12, 2012.
Final Office Action for U.S. Appl. No. 12/010,587 dated Mar. 22, 2012.
Notice of Allowance for U.S. Appl. No. 12/966,861 dated Apr. 11, 2012.
Non-Final Office Action for U.S. Appl. No. 13/437,597 dated Jul. 9, 2012.
Restriction Requirement for U.S. Appl. No. 13/452,183 dated Jul. 10, 2012.
Notice of Allowance for U.S. Appl. No. 12/979,086 dated Jul. 19, 2012.
Non-final Office Action for U.S. Appl. No. 12/747,454 dated Aug. 6, 2012.
Final Office Action for U.S. Appl. No. 12/966,797 dated Aug. 8, 2012.
Non-Final Office Action for U.S. Appl. No. 13/452,183 dated Aug. 8, 2012.
Non-Final Office Action for U.S. Appl. No. 13/204,481 dated Sep. 7, 2012.
Non-Final Office Action for U.S. Appl. No. 13/567,933 dated Sep. 12, 2012.
Non-Final Office Action for U.S. Appl. No. 11/483,636 dated Oct. 10, 2012.
Advisory Action for U.S. Appl. No. 12/966,797 dated Oct. 18, 2012.
European Office Action dated Oct. 19, 2012.
Notice of Allowance for U.S. Appl. No. 13/437,597 dated Oct. 26, 2012.
Non-Final Office Action for U.S. Appl. No. 13/086,931 dated Nov. 7, 2012.
Non-Final Office Action for U.S. Appl. No. 13/492,512 dated Nov. 21, 2012.
Non-Final Office Action for U.S. Appl. No. 13/463,329 dated Nov. 21, 2012.
Notice of Allowance for U.S. Appl. No. 11/483,636 dated Nov. 23, 2012.
Notice of Allowance for U.S. Appl. No. 10/270,163 dated Dec. 13, 2012.
Non-Final Office Action for U.S. Appl. No. 12/966,797 dated Dec. 13, 2012.
Non-Final Office Action for U.S. Appl. No. 13/559,230 dated Dec. 20, 2012.
Non-Final Office Action for U.S. Appl. No. 13/675,936 dated Dec. 31, 2012.
Notice of Allowability for U.S. Appl. No. 11/483,636 dated Jan. 3, 2013.
Notice of Allowance for U.S. Appl. No. 12/747,454 dated Jan. 8, 2013.
Notice of Allowance for U.S. Appl. No. 13/437,597 dated Jan. 9, 2013.
Final Office Action for U.S. Appl. No. 12/010,587 dated Jan. 28, 2013.
Non-Final Office Action for U.S. Appl. No. 13/620,098 dated Feb. 8, 2013.
Final Office Action for U.S. Appl. No. 13/204,481 dated Feb. 25, 2013.
Non-Final Office Action for U.S. Appl. No. 13/492,512 dated Feb. 26, 2013.
Non-Final Office Action for U.S. Appl. No. 11/015,741 dated Mar. 13, 2013.
Final Office Action for U.S. Appl. No. 13/567,933 dated Mar. 15, 2013.

(56) References Cited

OTHER PUBLICATIONS

Notice of Allowance for U.S. Appl. No. 11/242,127 dated Apr. 26, 2013.
Notice of Allowance for U.S. Appl. No. 13/437,597 dated Apr. 29, 2013.
Non-Final Office Action for U.S. Appl. No. 12/747,454 dated May 10, 2013.
Notice of Allowance for U.S. Appl. No. 11/185,724 dated May 20, 2013.
Non-Final Office Action for U.S. Appl. No. 13/559,242 dated Jun. 7, 2013.
Applicant-Iniated Interview Summary for U.S. Appl. No. 13/204,481 dated Jul. 29, 2013.
Corrected Notice of Allowability for U.S. Appl. No. 11/185,724 dated Aug. 1, 2013.
Final Office Action for U.S. Appl. No. 13/086,931 dated Aug. 5, 2013.
Notice of Allowance for U.S. Appl. No. 12/966,797 dated Aug. 7, 2013.
Notice of Allowance for U.S. Appl. No. 12/010,587 dated Aug. 14, 2013.
Notice of Allowance for U.S. Appl. No. 13/559,230 dated Aug. 20, 2013.
Non-Final Office Action for U.S. Appl. No. 13/860,315 dated Aug. 26, 2013.
Notice of Allowance for U.S. Appl. No. 11/185,724 dated Sep. 3, 2013.
Non-Final Office Action for U.S. Appl. No. 13/204,481 dated Sep. 4, 2013.
Final Office Action for U.S. Appl. No. 13/620,098 dated Sep. 24, 2013.
Non-Final Office Action for U.S. Appl. No. 13/463,329 dated Sep. 25, 2013.
Notice of Allowance for U.S. Appl. No. 13/675,936 dated Sep. 25, 2013.
Supplemental Notice of Allowance for U.S. Appl. No. 12/966,797 dated Oct. 3, 2013.
Supplemental Notice of Allowance for U.S. Appl. No. 13/559,230 dated Oct. 4, 2013.
Notice of Allowance for U.S. Appl. No. 11/185,724 dated Nov. 1, 2013.
Final Office Action for U.S. Appl. No. 12/747,454 dated Nov. 6, 2013.
Notice of Allowance for U.S. Appl. No. 13/086,931 dated Nov. 19, 2013.
United States District Court of North Carolina. *Pergo* (*Europe*) *AB* v *Unilin Beheer BV*, Civil. Action No. 5:08-CV-91; Joint Stipulation of Dismissal.
Final Office Action for U.S. Appl. No. 12/747,454 dated Feb. 24, 2014.
Supplemental Notice of Allowance for U.S. Appl. No. 13/086,931 dated Apr. 14, 2014.
Abandoned U.S. Appl. No. 13/420,282 dated Mar. 14, 2012.
Pending U.S. Appl. No. 14/044,572, filed Oct. 2, 2013.
Non-Final Office Action for U.S. Appl. 13/957,971 dated Feb. 20, 2014.
Non-final Office Action for U.S. Appl. No. 13/620,098 dated Mar. 21, 2014.
Pending U.S. Appl. No. 14/223,365 dated Mar. 24, 2014.
Final Office Action for U.S. Appl. No. 13/463,329 dated May 16, 2014.
Non-Final Office Action for U.S. Appl. No. 14/097,001 dated Jun. 12, 2014.
Notice of Allowance for U.S. Appl. No. 13/567,933 dated Jun. 17, 2014.
Non-Final Office Action for U.S. Appl. No. 14/223,365 dated Jul. 3, 2014.
Notice of Allowance for U.S. Appl. No. 13/620,098 dated Jul. 22, 2014.
European Patent Office Board of Appeal Decision for Application No. 01906461.7 dated Jul. 24, 2014.
Non-Final Office Action for U.S. Appl. No. 14/086,724 dated Aug. 1, 2014.
Final Office Action for U.S. Appl. No. 13/957,971 dated Sep. 3, 2014.
Non-final Office Action for U.S. Appl. No. 12/747,454 dated Sep. 12, 2014.
Notice of Allowance for U.S. Appl. No. 13/620,098 dated Sep. 18, 2014.
Non-Final Office Action for U.S. Appl. No. 14/086,757 dated Oct. 7, 2014.
Non-Final Office Action for U.S. Appl. No. 14/076,879 dated Oct. 14, 2014.
Notice of Allowance for U.S. Appl. No. 13/567,933 dated Oct. 16, 2014.
Notice of Allowance for U.S. Appl. No. 14/223,365 dated Nov. 5, 2014.
Advisory Action for U.S. Appl. No. 13/957,971 dated Dec. 17, 2014.
Notice of Allowance for U.S. Appl. No. 13/463,329 dated Dec. 31, 2014.
Final Office Action for U.S. Appl. No. 14/086,724 dated Jan. 16, 2015.
Notice of Allowance for U.S. Appl. No. 13/860,315 dated Jan. 20, 2015.
Non-Final Office Action for U.S. Appl. No. 13/957,971 dated Jan. 30, 2015.
Notice of Allowance for U.S. Appl. No. 13/567,933 dated Feb. 4, 2015.
Final Office Action for U.S. Appl. No. 14/076,879 dated Mar. 4, 2015.
Notice of Allowance for U.S. Appl. No. 13/860,315 dated Mar. 5, 2015.
Final Office Action for U.S. Appl. No. 14/086,757 dated Mar. 17, 2015.
Non-Final Office Action for U.S. Appl. No. 13/204,481 dated Mar. 25, 2015.
Non-Final Office Action for U.S. Appl. No. 14/456,755 dated Mar. 27, 2015.
Notice of Allowance for U.S. Appl. No. 13/860,315 dated Apr. 6, 2015.
Non-Final Office Action for U.S. Appl. No. 14/044,572 dated Apr. 6, 2015.
Notice of Allowance for U.S. Appl. No. 14/086,724 dated Apr. 15, 2015.
Final Office Action for U.S. Appl. No. 14/076,879 dated Apr. 24, 2015.
Notice of Allowance for U.S. Appl. No. 13/048,646 dated May 14, 2015.
Notice of Allowance for U.S. Appl. No. 13/567,933 dated May 22, 2015.
Notice of Allowance for U.S. Appl. No. 14/086,724 dated Jun. 1, 2015.
Non-Final Office Action for U.S. Appl. No. 14/086,757 dated Aug. 3, 2015.
Final Office Action for U.S. Appl. No. 13/957,971 dated Aug. 6, 2015.

* cited by examiner

SET OF PANELS

CROSS REFERENCE TO RELATED APPLICATIONS

This application is a continuation of and claims priority to U.S. patent application Ser. No. 14/223,365, filed Mar. 24, 2014, which is a continuation of and claims priority to U.S. patent application Ser. No. 13/086,931, filed Apr. 14, 2011, which claims priority to German Patent application No. 102010020089.1 filed May 10, 2010, the entire disclosures of which are incorporated herein by reference in their entireties.

DESCRIPTION

The invention relates to asset of panels comprising a first panel and at least a second panel, wherein the panels are respectively provided with a first edge and with a second edge and wherein the first edge of the first panel and the second edge of the second panel are configured to establish a connection between the first and the second panel.

Such a set of panels is known, for example, from WO 00/47841. In this case, a first edge has a lower lip with a step, while a second edge has a downwardly open locking groove. In a connected state of the panels, the step cooperates with the downwardly open locking groove so that a positive-fit connection in a horizontal direction is formed. By means of a relative movement of the panels with respect to each other, the two edges can in this case be connected vertically relative to the plane of laying.

In order to lock the panels vertically relative to the plane of laying, a separate clip is provided, which is attached to one of the edges and has a moveable clip head, which in the connected state of the panels cooperates with a locking surface on the other edge.

A connection as described in WO 00/47841 can advantageously be used in floor panels. It facilitates the laying of the floor panels because the floor panels can be locked with each other by a simple downward movement of one of the panels.

However, there is a need for an improvement of the edges including the clip with regard to the joint strength and to further simplify their manufacture.

The invention is therefore based on the object of providing a set of panels, the edges of which can be connected with each other, wherein the connection between the edges has good properties and is comparatively simple to produce.

The object on which the invention is based is achieved with the combination of features of claim 1. Preferred exemplary embodiments can be found in the dependent claims.

According to claim 1, it is provided that the clip head, in a locking position, exerts a force on a locking surface of the second edge which urges the second edge of the second panel against the lower lip of the first edge of the first panel, wherein the locking position lies between an undeformed initial position and an assembly position. In this case, the assembly position is the position in which the clip is maximally deformed when the profiles are connected. Preferably, the locking position is closer to the assembly position than to the initial position.

This means that the clip continues to remain deformed in the locking position. Due an appropriate configuration of the clip head, and the locking surface cooperating with the clip head, it can be ensured that, even given certain manufacturing tolerance's, the clip head always rests securely against the locking surface and exerts a force due to which the one lower contact surface of the second edge rests securely on a contact surface of the lower lip of the first edge.

As was already explained, the locking position in a preferred embodiment is closer to the assembly position than to the initial position. If, for example, the deformation (deformation work) in the assembly position is set to 100%, then in a preferred embodiment, the deformation in the locking position is supposed to be at least 50%. Furthermore, in a preferred embodiment, the deformation in the locking position, relative to the maximum deformation in the assembly position; may exceed 60 or even exceed 70%.

In a preferred embodiment, the clip is inserted, with a fastening area, in a clip groove having a lower groove wall, an upper groove wall and a groove bottom. In this case, in a preferred embodiment, the clip head does not protrude beyond an imaginary extension of the lower groove wall in the initial position, wherein the clip head sweeps over this imaginary extension during the movement, starting from the initial position into the assembly position.

In addition, it can be provided that the clip including the clip head, does not protrude beyond an imaginary extension of the upper groove wall.

Preferably, the upper groove wall and the lower groove wall are parallel to each other. The upper groove wall and the lower groove wall can in this case be parallel to the plane of laying or can also include an angle. The angle can be, for example 0° to 20°.

When the panels are connected, the movable clip head can execute a pivoting movement about a pivot axis located between the lower and upper groove wall or between their imaginary extensions. In this case, the pivot axis preferably extends along the edges.

The fastening area can have four fastening surfaces separate from one another, of which two cooperate with the upper groove wall and the other two with the lower groove wall. Preferably, the four fastening surfaces, in the direction of the groove bottom, are in this case arranged offset relative to one another. The cross section of the fastening area in this case approximately has a zigzag shape on which the moveable clip head is formed to be pivotable.

A fifth fastening surface of the fastening area can be provided, which rests against the groove bottom. The fifth fastening surface thus ensures, that the clip is fixed in the direction of the groove bottom.

The invention will now be explained in more detail with reference to an exemplary embodiment shown in the figures. In the figures.

Figure 1:
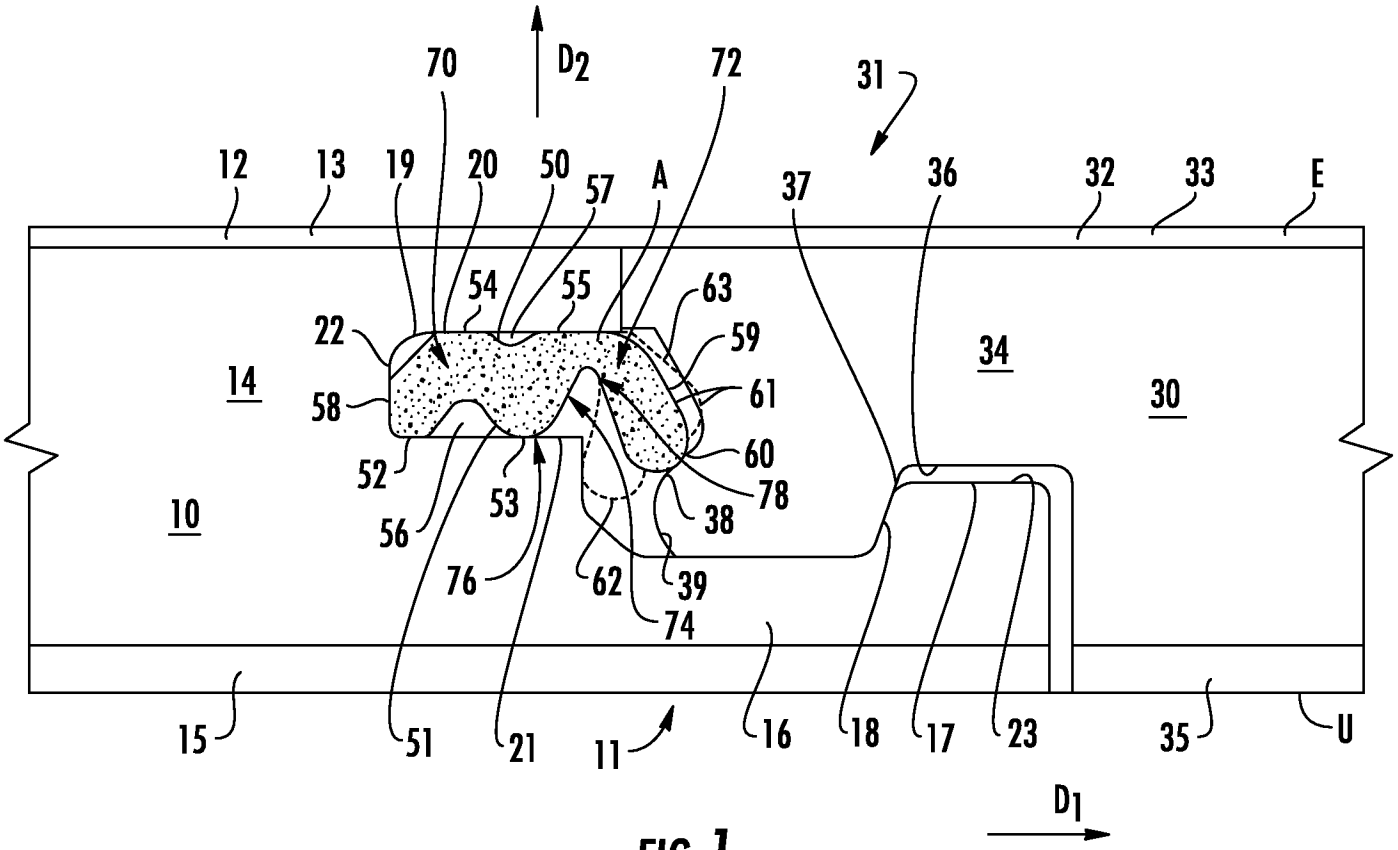
FIG. 1 shows two panels in the connected state.

FIG. 1 shows a cross section of a detail of a first panel 10 and a second panel 30, each of which are supposed to have a rectangular basic shape. It can be seen in FIG. 1 that the first panel 10 has a first edge 11 cooperating with a second edge 31 of the second panel 30. The first panel 10 in this case also has a second edge which corresponds to the second edge 31 of the second panel 30 but is not shown in FIG. 1. The same applies, mutatis mutandis, to the second panel 30, which also has a first edge which is not shown and corresponds to the first edge 11 of the first panel 10. Preferably, the first edge and the second edge are disposed opposite to one another on a panel.

The panels 10, 30 preferably are floor panels resting on an underlying floor U. A plane of laying E, in which the upper sides 12, 32 of the panels 10, 30 lie, extends parallel to the underlying floor U. The upper sides 12, 32 in this case comprise a decorative layer 13, 33 attached to a core 14 and 34, respectively. The core 14, 34 can consist of MDF or HDF, but can also be formed from a different material.

On an underside, the panel 10 has an underlayer 15. The corresponding underlayer of the constructionally identical panel 30 is designated with the reference numeral 35.

The first edge 11 has a lower lip 16 with a step 17 forming a substantially vertical locking surface 18.

In the connected state of the panels 10, 30 or the edges 11, 31 as it is shown in FIG. 1, the step 17 reaches into a locking groove 36 of the second edge 31 open towards the underlying floor U. The locking groove has in this case a substantially vertical locking surface 37 which cooperates with the locking surface 18 of the step 17. The cooperation of the substantially vertical surfaces 18, 37 prevents the second panel 30 from being detachable from the first panel 10 in the direction D1, i.e. parallel to the plane of laying E.

A lock of the panels 10, 30 in the vertical direction D2 is ensured by a clip, which in its entirety is designated with 50. In this case, in the example of the floor panels, the vertical direction D2 is perpendicular to the plane of laying E.

The clip comprises a fastening area 51 which is disposed in a clip groove 19 of the first panel 10. The clip groove 19 has an upper groove wall 20 and a lower groove wall 21, both of which extend parallel to the plane of laying E. In addition, the clip groove 19 has a groove bottom 22.

The fastening area 51 of the clip 50 has four fastening surfaces 52, 53, 54, 55 separate from one another, with lower fastening surfaces resting against the lower groove wall 21 and upper fastening surfaces 54, 55 resting against the upper groove wall 20. There is an interstice 56 between the lower fastening surfaces 52, 53. Such an interstice can also be found between the upper fastening surfaces 54, 55 and is designated with 57. The fastening surfaces 52, 53, 54, 55, in the direction of the groove bottom, or in this case in the direction D1, are arranged offset relative to one another. The clip 50, which is preferably of plastic, but which cart also consist of MDF or HDF, thus as a certain resilience or compressibility between the groove walls 20, 21, which can be utilized for clamping the clip 50 into the groove 19 in a simple manner.

A fifth fastening surface 58 adjoining to the lower fastening surface 52, rests against the groove bottom 22 and ensures a fixation of the clip in the groove 19 in the horizontal direction or in the direction opposite to the direction D1.

Clip 50 comprises a rear portion 70 and a front portion 72. As depicted in FIG. 1, front portion 72 protrudes from an upper region of rear portion 70 and is spaced from lower groove wall 21, thereby defining a transition wall portion 74, which connects to a lower side 76 of rear portion 70 and is more upwardly inclined than lower side 76 of rear portion 70 in order to connect to lower side 78 of front porch 72.

Moreover, the clip 50 has a pivotable clip head 59 which is which is connected to the fastening area 51 of the clip 50 so as to be pivotable about a pivoting axis A. FIG. 1 in this case shows the clip head 59 in a locking position in which the clip head 59, with a head end 60, rests against a locking surface 38 of the second edge 31. The head end 60 in this case has an approximately semi-circular configuration. In the direction towards the underlying floor U, the locking surface 38 transitions into a sliding surface 39, along which the clip head 59 slides with a sliding face 61 when the panels 10, 30 are connected with each other by means of a vertical downward movement of the second panel 30. The sliding surface 39 in this case transitions into the locking surface 38 without any appreciable edges or steps.

In addition, FIG. 1 indicates two further positions of the clip head 59, which are in each case shown by means of dashed lines. The locking head 59 can assume an assembly position 62 in the process, so that the second edge 31, when the panels are connected, can be lowered, to the extent that it abuts against the lower lip 16 of the first edge 11. However, the clip head 59 is strongly deformed in the assembly position 62 so that the restoring forces urge the clip head upwards again until the clip head 59 is clamped against the locking surface 38 with its head end 60.

Furthermore, the initial position 63, in which the clip head 59 and the clip 50, respectively, are undeformed, can be seen in FIG. 1. It can be clearly seen that the locking position deviates from the initial position. This means that the clip 50 is still deformed in the locking position, and that this deformation ensures that the clip head 59, with its head end 60, presses-against the locking surface 38. This leads to the clip head 59 pressing the second edge 31 against the lower lip 16, via the locking surface 38.

Figure 2:
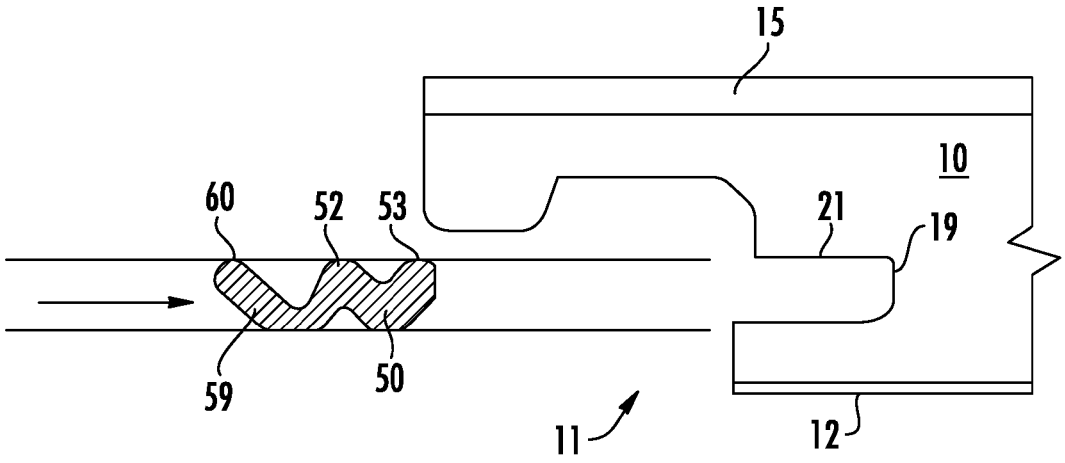
FIG. 2 shows a clip during insertion into a clip groove.

FIG. 2 shows the panel 10 with its edge 11, with the panel now standing-on its head, so that the lower side 12 is disposed at the bottom and the underlayer 15 at the top. FIG. 2 shows how the clip 50 can be inserted into the groove 19 by means of a linear movement. In this case, the clip 50 is in the undeformed state, with the clip head 59 assuming the initial position 63(see FIG. 1). In this state, the lower fastening surfaces 52, 53 of the fastening area 51 of the clip 50 and the head end 60 lie in an extension of the lower groove wall 21.

As it is shown in FIG. 2, the clip can be reeled off a drum prior to insertion into the groove 21. Because of its shape, in which the fastening areas 52, 53 and the head end 60 on the one hand, and the fastening areas 59, 50 on the other hand respectively lie in one line, the clip 50 can be reeled onto a drum without any appreciable warping.

It can be seen from FIG. 1, that, seen in the vertical direction, the head end 60, at least in the assembly position 62 of the clip head 59, lies below a plane parallel to the plane of laying E, in which an upper surface 23 of the step 17 lies.

Due to the above-mentioned zigzag shape, the clip has a maximal material thickness which is smaller than the distance of the groove walls 20, 21. Apart from a constricted area near the pivoting axis A, by means of which the pivotability of the clip head 59 relative to the fastening area 51 is adjusted, the material thickness varies only very little. It is thus possible for the clip produced according to the preferred production by means of the extrusion process to be uniformly and quickly-cooled off.

The invention claimed is:

1. A set of floor panels, said set of floor panels comprising a first floor panel and at least a second floor panel;

wherein the first floor panel comprises a first edge; wherein the second floor panel comprises a second edge, the first edge and the second edge configured to establish a connection between the first and second floor panels;

wherein said second edge is adapted to connect with the first edge by a relative downward movement of the second edge with respect to the first edge; wherein the first edge has a distally protruding lower lip with a step forming a horizontally active locking surface; wherein said step reaches into a downwardly open locking groove of the second edge in a connected condition of the first and second floor panels, said locking groove also having a horizontally active locking surface which cooperates with the horizontally active locking surface of the step in said connected condition of the first and second floor panels, thereby locking the second floor panel and the first floor panel in a direction in the plane of the floor panels and perpendicular to the first and second edges;

wherein a separate clip is provided at the first edge, which clip has a clip head, at least said clip head being movable, and wherein said clip head, in the connected state of the floor panels, cooperates with a vertically active locking surface on the second edge, thereby locking the floor panels in a direction perpendicular to the plane of the floor panels;

wherein said clip head is movable between at least an initial position in which said clip is in a free condition and an assembly position in which said clip is maximally deformed during connecting the floor panels;

wherein said clip is inserted in a groove having a lower groove wall, an upper groove wall and a groove bottom wall extending between the lower and upper groove walls; wherein said upper and lower groove walls are substantially parallel to each other and include an angle in respect to the plane of the connected floor panels, said groove thereby forming an inclined seat for the clip;

wherein said clip head does not protrude beyond an imaginary extension of said lower groove wall in the initial position; wherein said clip, including said clip head, does not protrude beyond an imaginary extension of said upper groove wall;

said clip comprising a rear portion substantially positioned in said groove and a front portion protruding from the rear portion, said front portion comprising said clip head; and wherein said clip comprises a stepped lower side, said stepped lower side defining a transition between said rear portion and said front portion, such that the front portion protrudes from an upper region of the rear portion and is spaced from the lower groove wall, thereby defining a transition wall portion, which connects to a lower side of said rear portion and is more upwardly inclined than the lower side of the rear portion in order to connect to a lower side of the front portion.

2. The set of floor panels of claim 1, wherein said transition wall portion, in the connected condition of the floor panels, is more upwardly inclined than said lower groove wall.

3. The set of floor panels of claim 2, wherein said transition wall portion forms an angle with said lower groove wall, which angle is larger than an angle formed between the vertically active locking surface and the plane of the coupled floor panels.

4. The set of floor panels of claim 1, wherein said lower side of the front portion has a different inclination with respect to the transition wall portion.

5. The set of floor panels of claim 1, wherein said transition wall portion forms an angle with said lower groove wall of more than 45 degrees.

6. The set of floor panels of claim 1, wherein said upper groove wall extends distally beyond said transition wall portion.

7. The set of floor panels of claim 1, wherein said second edge is adapted to connect with the first edge by a relative vertical movement when viewed in a cross-section perpendicular to the first edge.

8. The set of floor panels of claim 1, wherein said first and said second floor panels comprise upper sides which both comprise a decorative layer attached to a core of the floor panels.

9. The set of floor panels of claim 1, wherein said clip is made of plastic.

10. The set of floor panels of claim 1, wherein said vertically active locking surface in the direction towards an underside of the respective floor panel transitions into a sliding surface, along which the clip head slides with a sliding face when the floor panels are connected with each other by said downward movement.

11. The set of floor panels of claim 1, wherein said horizontally active locking surfaces are inclined with respect to the plane of the floor panels; and wherein also said vertically active locking surface is inclined, the latter having an inclination of approximately 45 degrees.

12. The set of floor panels of claim 1, wherein said clip is attached to the first edge of the first floor panel by clamping.

13. The set of floor panels of claim 1, wherein said clip head is elastically displaceable.

14. A set of floor panels, said set of floor panels comprising a first floor panel and at least a second floor panel;

wherein the first floor panel comprises a first edge;

wherein the second floor panel comprises a second edge, the first edge and the second edge configured to establish a connection between the first and second floor panels;

wherein said second edge is adapted to connect with the first edge by a relative downward movement of the second edge with respect to the first edge;

wherein the first edge has a distally protruding lower lip with a step forming a horizontally active locking surface; wherein said step reaches into a downwardly open locking groove of the second edge in a connected condition of the first and second floor panels, said locking groove also having a horizontally active locking surface which cooperates with the horizontally active locking surface of the step in said connected condition of the first and second floor panels, thereby locking the second floor panel and the first floor panel in a direction in the plane of the floor panels and perpendicular to the first and second edges;

wherein a separate clip is provided at the first edge, which clip has a distal end portion, at least said distal end portion being movable, and wherein said distal end portion, in the connected state of the floor panels, cooperates with a vertically active locking surface on the second edge, thereby locking the floor panels in a direction perpendicular to the plane of the floor panels;

wherein said distal end portion is movable between at least an initial position in which said clip is in a free condition and an assembly position in which said clip is maximally deformed during connecting the floor panels;

wherein said clip is inserted in a groove having a lower groove wall, an upper groove wall and a groove bottom wall extending between the lower and upper groove walls;

wherein said upper and lower groove walls are substantially parallel to each other and include an angle in respect to the plane of the connected floor panels, said groove thereby forming an inclined seat for the clip;

wherein said distal end portion does not protrude beyond an imaginary extension of said lower groove wall in the initial position; wherein said clip, including said distal end portion, does not protrude beyond an imaginary extension of said upper groove wall;

wherein said clip comprises a rear portion substantially positioned in said groove and a front portion protruding from the rear portion, said front portion comprising said distal end portion;

wherein said clip is provided with a recess at an underside of the clip, said recess at least comprising a first recess surface and a second recess surface, which recess surfaces form part of the clip and have a different orientation with respect to each other, said recess being located underneath the front portion and, in the connected condition of the floor panels, being situated, at least partially, distally beyond said lower groove wall; and wherein said first recess surface extends substantially from said lower groove wall in the connected condition of the floor panels, whereas said second recess surface substantially extends from the first recess surface towards said distal end portion of the clip.

15. The set of floor panels of claim 14, wherein said first recess surface is upwardly directed with respect to a bottom side of the panel, and forms an angle with said lower groove wall of more than 45 degrees.

16. The set of floor panels of claim 14, wherein said upper groove wall extends distally beyond said first recess surface.

17. The set of floor panels of claim 14, wherein said first recess surface is upwardly directed and forms an angle with said lower groove wall, which angle is larger than an angle formed between the vertically active locking surface and the plane of the floor panels.

18. The set of floor panels of claim 14, wherein said recess is at least partially bounded by said lower groove wall.

19. The set of floor panels of claim 14, wherein said second edge is adapted to connect with the first edge by a relative vertical movement when viewed in a cross-section perpendicular to the first edge.

20. The set of floor panels of claim 14, wherein said first and said second floor panels comprise upper sides which both comprise a decorative layer attached to a core of the floor panels.

21. The set of floor panels of claim 14, wherein said clip is made of plastic.

22. The set of floor panels of claim 14, wherein said vertically active locking surface in the direction towards an underside of the respective floor panel transitions into a sliding surface, along which the distal end portion slides with a sliding face when the floor panels are connected with each other by said downward movement.

23. The set of floor panels of claim 14, wherein said horizontally active locking surfaces are inclined with respect to the plane of the floor panels; and wherein also said vertically active locking surface is inclined, the latter having an inclination of approximately 45 degrees.

24. The set of floor panels of claim 14, wherein said clip is attached to the first edge of the first floor panel by clamping.

25. The set of floor panels of claim 14, wherein said distal end portion is elastically displaceable.

26. The set of floor panels of claim 14, wherein said distal end portion is formed by a clip head.

* * * * *